US006213829B1

(12) United States Patent
Takahashi et al.

(10) Patent No.: US 6,213,829 B1
(45) Date of Patent: Apr. 10, 2001

(54) COMPONENT LAYOUT FOR OUTBOARD MOTOR

(75) Inventors: Masanori Takahashi; Noriyoshi Hiraoka, both of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/130,061

(22) Filed: Aug. 6, 1998

(30) Foreign Application Priority Data

Aug. 6, 1997 (JP) ..... 9-212207

(51) Int. Cl.[7] ..... B63H 20/00
(52) U.S. Cl. ..... 440/113; 440/900
(58) Field of Search ..... 440/77, 113, 900

(56) References Cited

U.S. PATENT DOCUMENTS 5,041,034 * 8/1991 Sakamoto ..... 440/76
5,370,563 * 12/1994 Yamazaki et al. ..... 440/77
5,375,578 * 12/1994 Kato et al. ..... 123/516
5,425,336 * 6/1995 Nakayama ..... 123/198 R
5,724,936 * 3/1998 Osakabe ..... 123/198 R
5,803,036 * 9/1998 takahashi et al. ..... 123/179.25

* cited by examiner

*Primary Examiner*—Sherman Basinger
(74) *Attorney, Agent, or Firm*—Ernest A. Beutler

(57) ABSTRACT

A number of embodiments of outboard motor that are comprised of a power head consisting of a multi-cylinder internal combustion engine and a surrounding protective cowling. Each embodiment also includes a drive shaft housing and lower unit, the latter of which contains a propulsion device for propelling an associated watercraft. The engines are mounted within the protective cowling so their crankshafts rotate about vertically extending axes. In each case the crankshaft is coupled to a drive shaft that depends into the drive shaft housing and lower unit for driving the propulsion device. A flywheel is affixed to the upper end of the crankshaft. A first accessory drive is affixed to the crankshaft below the flywheel for driving at least one engine accessory. The engine accessory is mounted at an upper end of the engine and at least in part within the outer peripheral surface of the flywheel in top plan view. Various alternative locations for the components of the engine including specifically an alternator and a starter motor are disclosed.

16 Claims, 22 Drawing Sheets

COMPONENT LAYOUT FOR OUTBOARD MOTOR

BACKGROUND OF THE INVENTION

This invention relates to an outboard motor and more particularly to an improved construction and component layout for a four cycle outboard motor.

In outboard motors, it is a common practice to employ a two cycle internal combustion engine as a power unit. Such engines have considerable advantages for this particular type of application. Because of their relatively compact nature, simple construction and high relative output for their displacement, they are well suited for this purpose. However, because of emission concerns, two cycle engines are being replaced by four cycle engines in these applications.

There are, however, not only space problems in connection with substituting four cycle engines for two cycle engines, but there is also a problem in that the engine has more complexity and the layout of the engine and its components presents considerable problems for the designer. To further complicate the problem, frequently the engine is provided also with an alternator so as to charge a storage battery or electrical system in the associated watercraft. The alternator must be driven off of the engine and this further complicates the positioning of components in the power head and the driving of those components which must be driven from the engine. Furthermore, there is a strong desire to maintain the outboard motor power head in such a nature that it can be easily serviced, particularly while still attached to the transom of the associated watercraft.

It is, therefore, a principle object of this invention to provide an improved outboard motor construction particularly employing a four cycle internal combustion engine.

It is a further object of this invention to provide an improved four cycle engine powered outboard motor having accessories driven by the engine and positioned in a compact and yet serviceable manner.

A further difficulty with the use of four cycle engines is caused by the fact that the crankshaft of the engine is normally at the front of the power head to facilitate connection to the drive shaft. The drive shaft is normally placed forwardly in the drive shaft housing. Because of the fact that the engine generally uses overhead valves and at least one overhead camshaft the center of gravity of the outboard motor and/or the power head is displaced rearwardly. This can cause vibration problems.

It is, therefore, a further object of this invention to provide an improved outboard motor construction particularly employing a four cycle internal combustion engine with a forwardly located center of gravity.

SUMMARY OF THE INVENTION

This invention is adapted to be embodied on an outboard motor that is comprised of a power head consisting of a multi-cylinder internal combustion engine and a surrounding protective cowling. The outboard motor also includes a drive shaft housing and lower unit, the latter of which contains a propulsion device for propelling an associated watercraft. The engine is mounted within the protective cowling so that its crankshaft rotates about a vertically extending axis. The crankshaft is coupled to a drive shaft that depends into the drive shaft housing and lower unit for driving the propulsion device. A flywheel is affixed to the upper end of the crankshaft. A first accessory drive is affixed to the crankshaft below the flywheel for driving at least one engine accessory. The engine accessory is mounted at an upper end of the engine and at least in part within the outer peripheral surface of the flywheel in top plan view.

DETAILED DESCRIPTION OF THE PREFERRED EMBODIMENTS

General Construction and Embodiment of FIGS. 1–5

Figure 1:
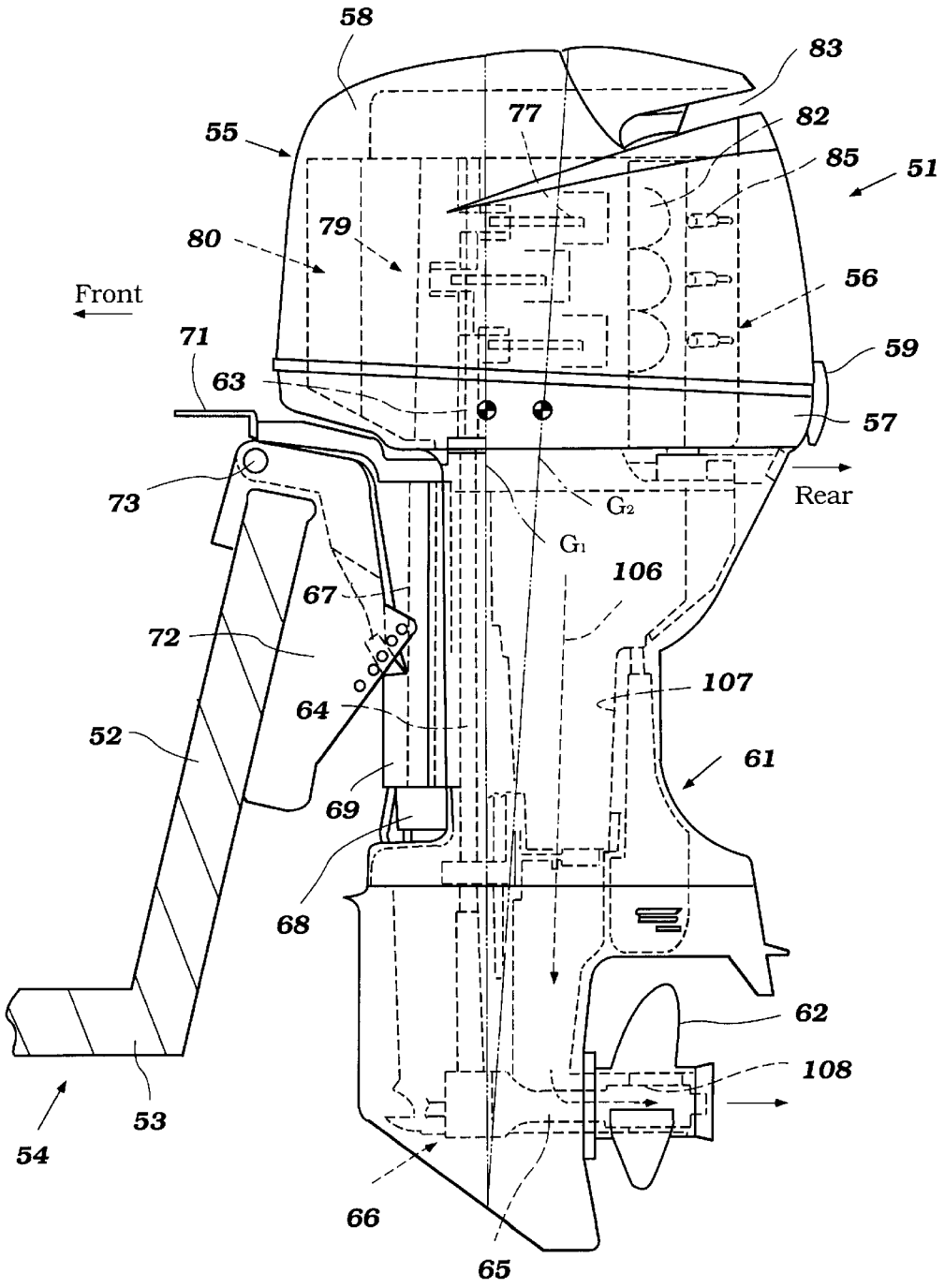
FIG. 1 is a side elevational view of an outboard motor having a construction that is typical for all embodiments of the invention, but which shows specifically a first embodiment of the invention as attached to the transom of a watercraft, that is shown partially and in cross-section.

Referring now in detail to the drawings and initially to FIG. 1, an outboard motor having a general construction that is typical of all of the embodiments is illustrated generally by the reference numeral 51 and is shown attached to the transom 52 of a hull 53 of a watercraft, indicated generally by the reference numeral 54.

The outboard motor 51 is comprised of a power head, indicated generally by the reference numeral 55, which is comprised of a powering internal combustion engine, indicated generally at 56, and a surrounding protective cowling that is comprised of a lower tray portion 57 and an upper, main cowling portion 58. The main cowling portion 58 is detachably connected to the tray portion 57 in a suitable manner, including a latch mechanism 59.

A drive shaft housing and lower unit 61 depends from the power head 55 and carries a propulsion device in the form of a propeller 62 for propelling the associated watercraft 54.

As is typical with outboard motor practice, the engine 56 is supported in the power head 55 so that its crankshaft 63 rotates about a vertically disposed axis. This facilitates connection to a drive shaft 64 that is journaled in the drive shaft housing and lower unit 61 in an appropriate manner. The drive shaft 64 drives a propeller shaft 65 to which the propeller 62 is affixed through a conventional, forward, neutral, reverse transmission, shown schematically at 66.

A steering shaft 67 is affixed to the drive shaft housing 61 by means that include a lower bracket 68. This steering shaft 67 is journaled in a swivel bracket 69 for steering of the outboard motor 51 and the associated watercraft 54 in a known manner. A tiller 71 is affixed to the upper end of the steering shaft 67 so as to control this steering movement.

The swivel bracket 69 is connected to a clamping bracket 72 by means of a pivot pin 73 for tilt and trim movement of the outboard motor 51 in a well known manner. The clamping bracket 72 has a suitable means to provide a detachable connection to the watercraft transom 52.

Referring now in more detail specifically to FIG. 2, the internal combustion engine 56 and certain of its auxiliaries will now be described in more detail. The engine 56 in this embodiment, as well as several of the other embodiments, is of the four cylinder, inline type. As will become readily apparent from the following description, it will be understood that the invention can be employed with engines having other cylinder arrangements such as V-type engines. Also, the invention may be practiced with engines having different cylinder numbers than the specific four cylinder construction which is utilized in all illustrated embodiments.

The engine 56 is also in all embodiments herein described as operating on a four stroke principle. Although some features of the invention can be employed with two stroke engines, the invention has particular utility with four stroke engines because of their greater complexity and the fact that they normally have a number of auxiliaries that are driven from the engine crankshaft, such as the crankshaft 63.

The engine 56 is comprised of a cylinder block 74 which, as already noted, is formed with four aligned, vertically spaced cylinder bores 75. Pistons 76 are supported for reciprocation with each of the cylinder bores 75. The pistons 76 are coupled by means of connecting rods 77 to the throws 78 of the crankshaft 63. The crankshaft 63 is rotatably journaled in a crankcase chamber that is formed by a skirt of the cylinder block 74 and a crankcase member 79 that is affixed thereto.

It should be understood that although certain details of the internal construction of the engine 56 are illustrated and will be described, the invention deals more with the manner of driving certain auxiliaries for the engine and the location of these auxiliaries and the drives for them within the power head 55. For that reason, the following description of the internal components of the engine 56 should be considered as only exemplary of those constructions with which the invention may be utilized.

A cylinder head assembly, indicated generally by the reference numeral 81, is affixed to the cylinder block 74 in a suitable manner. This cylinder head assembly 81 includes a main cylinder head member that has individual recesses 82 that close the ends of the cylinder bores 75 above the pistons 76 and form with these elements the combustion chambers of the engine.

An induction system, indicated generally by the reference numeral 80, supplies an air charge to the engine combustion chambers. This induction system draws air from within the protective cowling. This air is admitted to the interior of the protective cowling through an air inlet opening 83 (FIG. 1) that is formed at the rear of the main cowling member 58 and is defined in major part by a cover piece that is affixed to the main cowling member 58 in a known manner.

This inlet opening 82 cooperates with a baffle arrangement so as to assist in the separation of water that is present in the air due to the marine environment. This air inlet arrangement appears in FIGS. 3–5 and includes a pair of upwardly extending inlet openings 84 that are formed in the upper surface of the main cowling member 58 beneath the aforenoted cover plate. These openings are disposed generally in the area where the cylinder head assembly 81 meets the cylinder block 74 as shown in FIG. 2.

Figure 2:
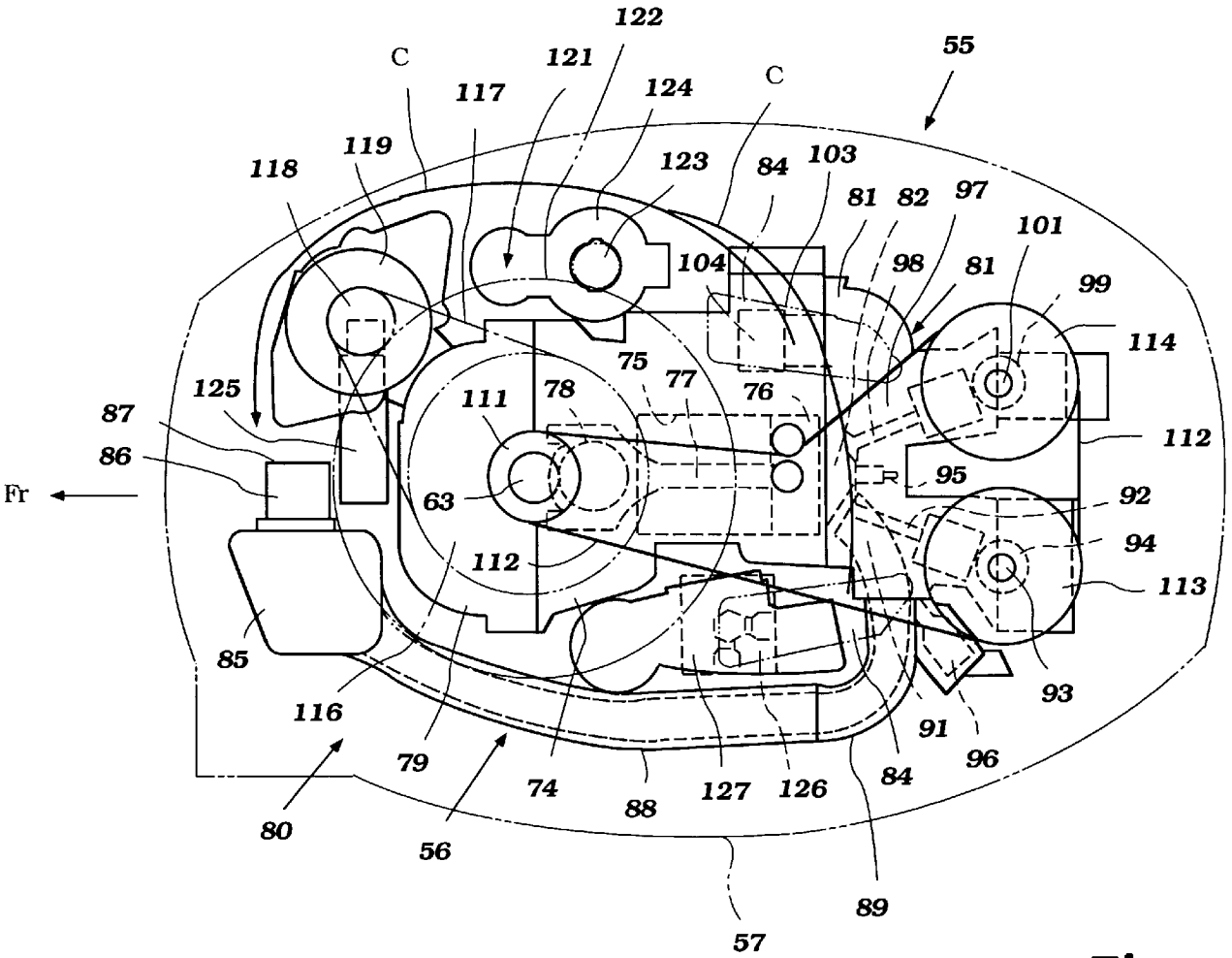
FIG. 2 is a top plan view of the power head of this embodiment with the protective cowling being shown in phantom.
Figure 3:
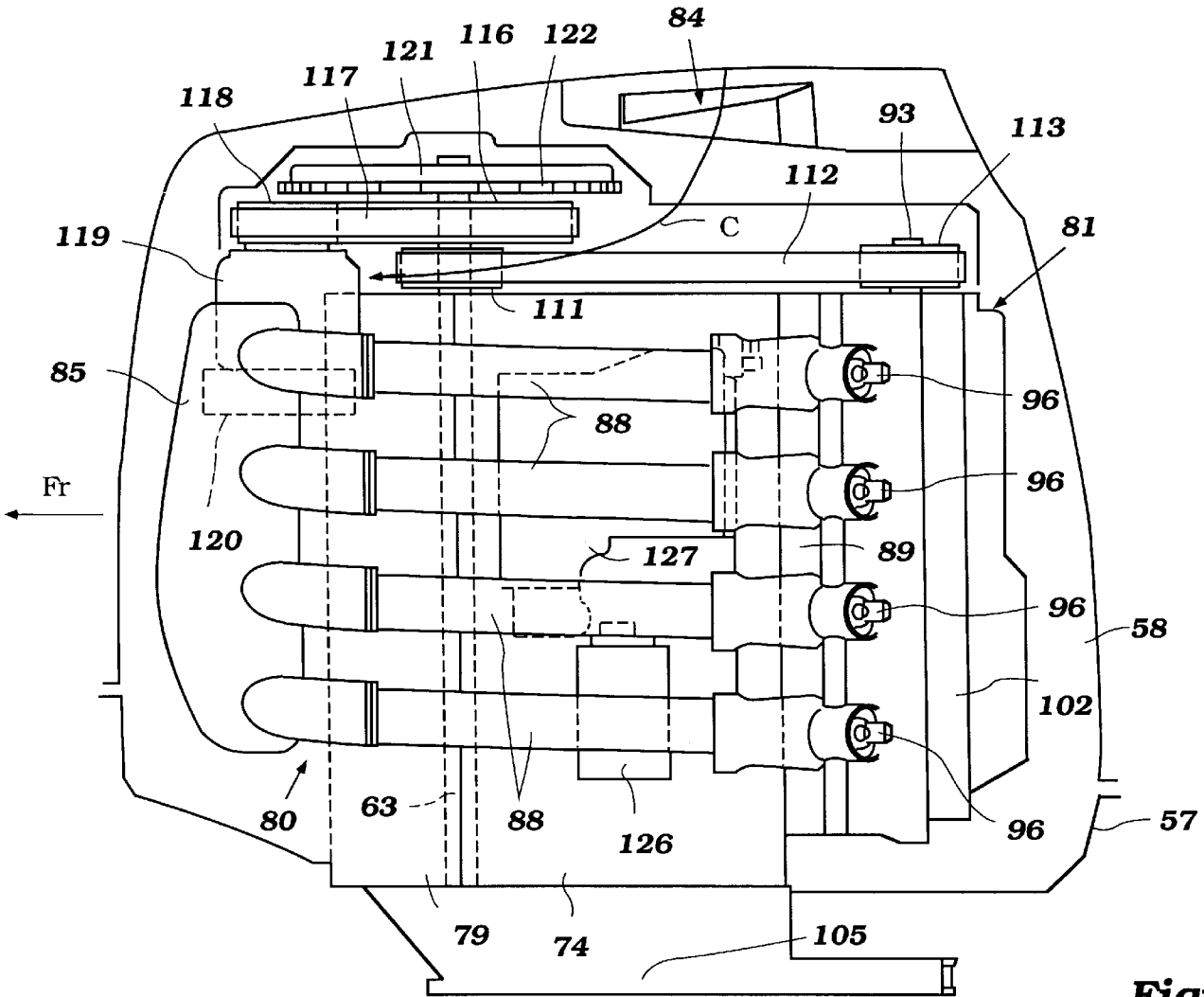
FIG. 3 is a left side elevational view of the power head construction as shown in FIG. 1 with the protective cowling being shown in outline.
Figure 4:
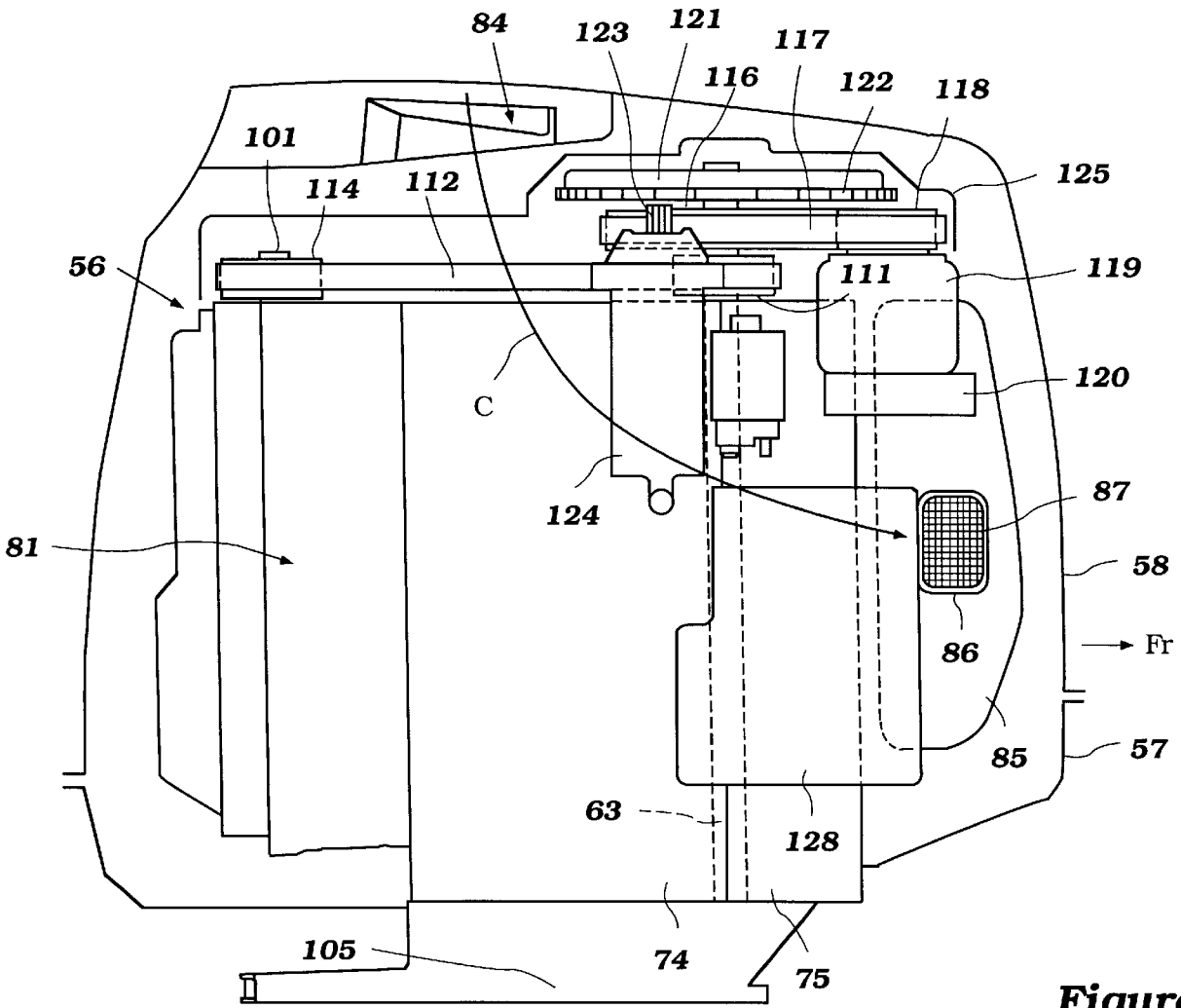
FIG. 4 is a side elevational view of the right hand side of this embodiment.

Referring now further to the engine air inlet system 80 by specific reference to FIGS. 2–4, an air inlet silencer device 85 is provided at the front of the power head 55 and extends vertically along a leading edge of the crankcase member 79 in this particular embodiment. This air inlet and silencer device 85 has a sidewardly positioned inlet tube 86 that defines an air inlet opening 87 into which air is drawn.

This air is then delivered from the silencer, inlet device 85 through a plurality of manifold runner sections 88 to an intake manifold 89 that is formed at least in part by the cylinder head assembly 81. It also may be comprised of a separate member that is attached to the cylinder head assembly 81 and which terminates in intake passages 91 that are formed in the main cylinder head assembly 81.

These intake passages 91 terminate at intake valve seats formed in the cylinder head recesses 82. Poppet type intake valves 92 cooperate with these valve seats to control the opening and closing and the entry of the air charge into the combustion chambers. These intake valves 92 are urged to a closed position by means of a suitable spring arrangement and are opened by an intake camshaft 93 that is suitably journaled in the cylinder head assembly 81 and which has cam lobes 94 for this purpose. The manner in which the intake camshaft 93 is operated will be described later.

Mounted in the cylinder head assembly 81 are a plurality of spark plugs 95, one for each cylinder in a preferred form. The spark plugs 95 have their gaps extending into the cylinder head recesses 82 and fire a charge which is formed in the cylinder head intake passages 91.

This charge is formed by fuel injectors 96 that are mounted in the cylinder head manifold portion 89 and which spray into the intake passages 91 toward the valve seats. The fuel injectors 96 are supplied with high pressure fuel through a suitable fuel supply system, certain components of which will be described later. The fuel injectors 96 and spark plugs 95 are controlled by an ECU, which will also be mentioned later.

The charge which has been ignited in the combustion chambers will expand and drive the pistons 76 downwardly in the cylinder bores so as to drive the crankshaft 63 in a manner well known in the art.

The burnt charge is discharged from the combustion chambers through exhaust passages 97 formed in the cylinder head assembly 81 on the side opposite the intake passages 91. These exhaust passages 97 begin at exhaust valve seats that are formed in the cylinder head recesses 82. Poppet type exhaust valves 98 cooperate with these exhaust valve seats to control the flow of exhaust gases from the combustion chamber.

These poppet type exhaust valves 98 are urged to their closed positions by means of suitable spring arrangements. The exhaust valves 98 are opened by the cam lobes 99 of an exhaust camshaft 101 that is journaled in the cylinder head assembly 81 for rotation about an axis that is parallel to the axis of rotation of the intake camshaft 93 and also of the crankshaft 63. The drive mechanism for the exhaust camshaft 101, like that of the intake camshaft 93, will be described later.

It should also be noted that the intake and exhaust camshafts 93 and 101 are journaled in cam chambers formed at the outer end of the cylinder head assembly 81 which are covered by means of a cam cover 102 that is affixed to the remainder of the cylinder head assembly in any known manner.

The exhaust gases from the cylinder head exhaust passages 79 are delivered to an exhaust manifold, indicated generally by the reference numeral 103, and which is formed in main part in the cylinder block assembly 74. This exhaust manifold 103 terminates in a downwardly directed discharge opening 104.

As is fairly conventional in outboard motor practice, the engine 56 is mounted on an exhaust guide plate 105 that is provided at the upper end of the drive shaft housing and lower unit assembly 81. Suitable exhaust gas passages are formed in the exhaust guide 105 and discharge the exhaust gases downwardly as shown by the arrow 106 in FIG. 1 to an expansion chamber 107 formed within the drive shaft housing 61. These exhaust gasses are then discharged to the atmosphere through an underwater through the hub exhaust gas discharge 108 formed in the hub of the propeller 62.

This underwater exhaust gas discharge is useful in silencing the exhaust gases when traveling at high speeds and when the propeller 62 is only shallowly submerged. When traveling at lower speeds or when idling, the underwater through the hub discharge 108 will be deeply submerged and there will be a high water pressure across its opening. At this same time, the exhaust gas pressure is relatively low, and hence there is provided an above the water idle exhaust gas discharge where the exhaust gases may exit under this running condition. Since these arrangements are well known in the art and form no particular part of the invention, further description of them is not believed to be necessary to permit those skilled in the art to practice the invention.

As has been noted, the important features of the invention deal with the various drives for the engine accessories and, therefore, the foregoing description as to the construction of the basic engine 56 should be considered as only typical of those which with the invention can be utilized. These accessory drives will now be described dealing first with the drive for the intake and exhaust camshafts 93 and 101.

As best seen probably in FIG. 2, the crankshaft 63 extends upwardly beyond the upper surface of the cylinder block 74 and crankcase member 79. A drive sprocket 111 is affixed to the crankshaft immediately adjacent the upper face of these two members. This drive sprocket 111 drives a timing belt 112 which is, in turn, that is entrained with driven sprockets 113 and 114 that are affixed to upwardly extending portions of the intake and exhaust camshafts 93 and 101, respectively. The diameters of the driving sprocket 111 and driven sprockets 113 and 114 is set so as to provide the 2 to 1 speed reduction in the drive of the intake and exhaust camshafts 93 and 101 from the crankshaft 63. A smaller idler sprocket 115 (FIG. 2) is mounted on the upper portion of the cylinder block 74 so as to assist in maintaining belt tension for the drive belt 112.

Immediately above the camshaft drive sprocket 111, a further accessory drive pulley 116 is affixed to the upwardly extending portion of the crankshaft 63. This drive pulley 116 drives a further drive belt 117 which, in turn, drives an alternator driving pulley 118. The alternator driving pulley 118 is affixed to the shaft of an electrical generating alternator 119 that is mounted on the crankcase member 79 on the side of the crank case member opposite to that where the air inlet device 85 is provided in this embodiment. A mounting bracket 120 is provided for this purpose.

Immediately above the drive pulley 106, a flywheel magneto 121 is affixed to the uppermost end of the crankshaft 63. This flywheel magneto has a ring gear 122 formed integrally thereon that is adapted to be engaged by a pinion gear 123 of a starter motor 124. The starter motor 124 is mounted on the cylinder block 74 in proximity to the alternator 119 and in a generally otherwise open area.

As may be best seen in FIG. 2, the starter motor 124 and alternator 119 are positioned in major part below the flywheel magneto 121 and lie in substantial part radially inwardly of its outer periphery so as to provide a very compact assembly.

A shroud cover 128 may be mounted on the upper side of the engine 56 to overlie these various drives including the flywheel magneto 121, alternator drive belt 117 and camshaft drive belt 112. However, the air flow from the air inlet openings 84, indicated by the arrows C to the induction system air inlet opening 87 will flow across this cover and cool these various accessory drives.

Figure 5:
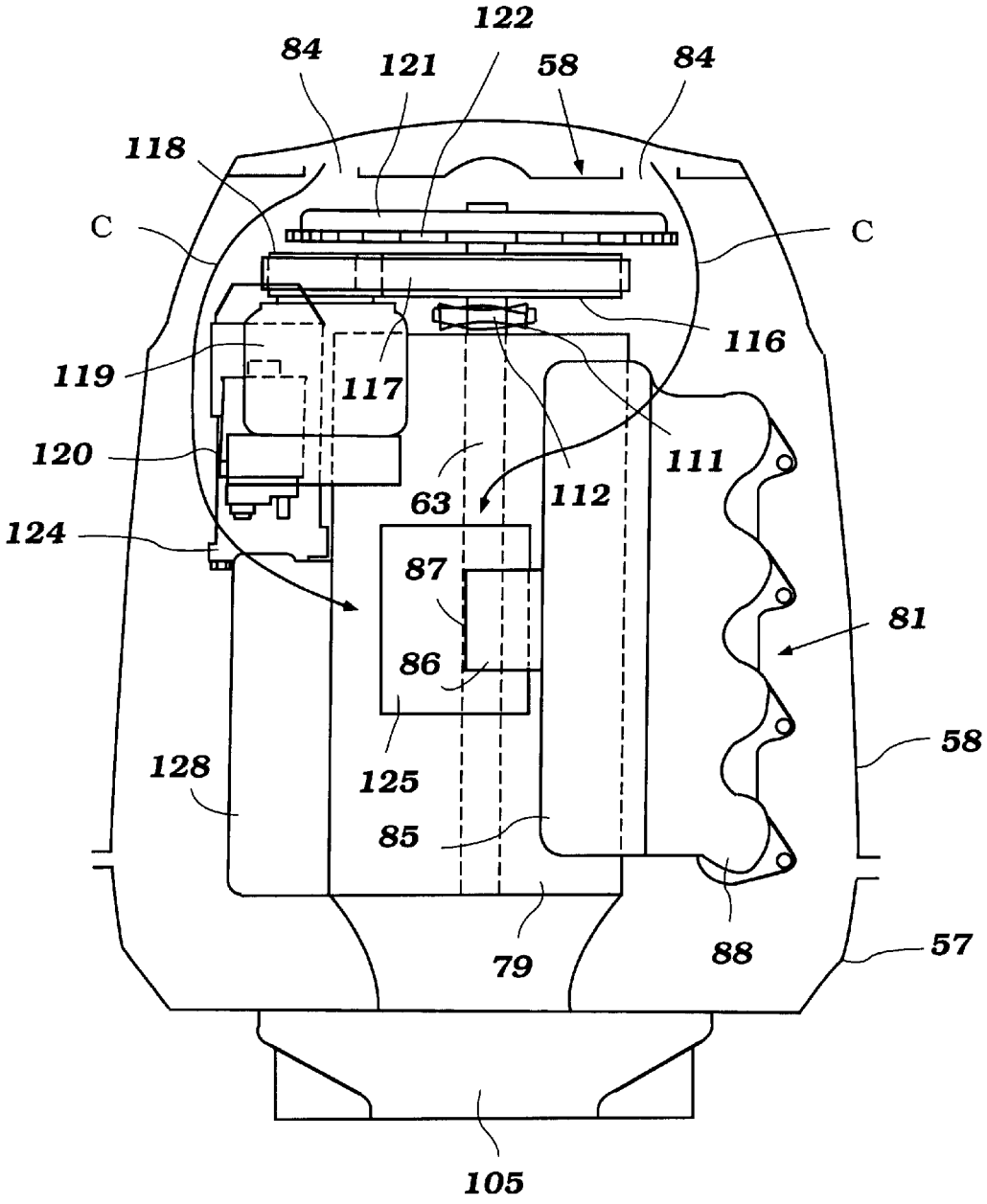
FIG. 5 is a front elevational of this embodiment, again showing the power head components only.
Figure 6:
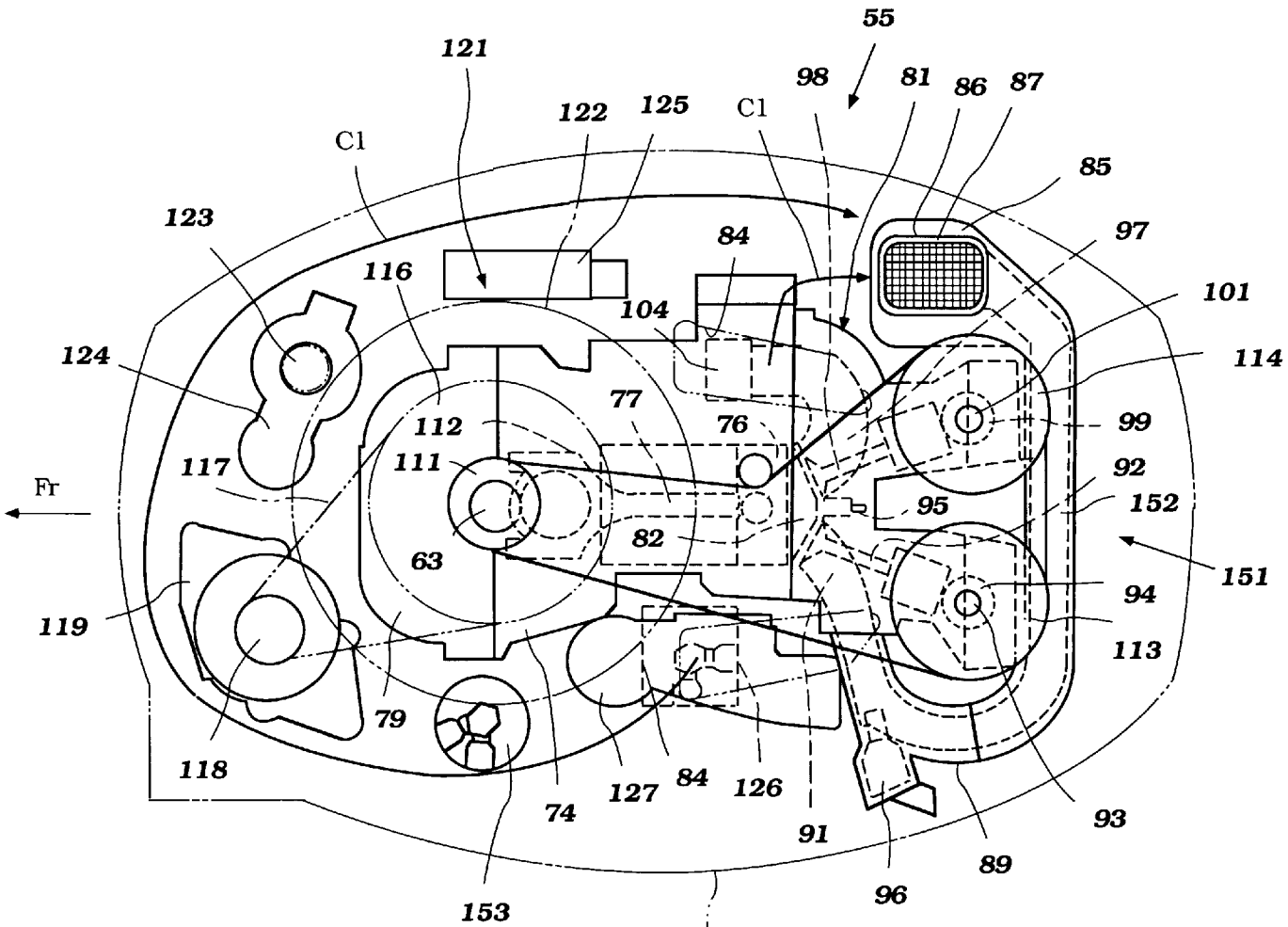
FIG. 6 is a top plan view, in part similar to FIG. 2, of a second embodiment of the invention showing the same components in the same fashion.

In addition to those components already described, certain other components associated with the engine are also mounted in locations that provide significant advantages. For example, it has been mentioned that the fuel injectors 96 and spark plugs 95 are controlled by an electronic control unit (ECU). This unit, as indicated by the -reference numeral 125, is mounted in this embodiment on the crankcase member 79 in close proximity to the air inlet device inlet opening 87 as seen in FIGS. 2 and 5. As a result, this unit will be protected and cooled by the induction system air flow, but also will be isolated from water vapor which will have been separated by the time it reaches this area through the air flow path C.

The fuel injection system also includes a fuel pump 126 and vapor separator 127 which are mounted as shown in FIGS. 2 and 3 beneath the intake manifold runners 88, but in an area where they are otherwise easily accessible for servicing and occupy space that would normally be void space. Thus, quite a compact assembly is provided with this arrangement and nevertheless, the components are mounted where they are easily serviceable and do not increase into any significant extent the size of the motor assembly.

An electrical circuit box 128 also appears in FIG. 4. This may contain various electrical components for engine operation. This is also mounted in a location to receive the cooling air flow.

The forward location of the relatively heavy alternator coupled with its forward mounting also reduces vibrations by moving the center of gravity closer to the forward connection of the drive unit to the steering shaft. As seen in FIG. 1 the actual center of gravity $G_1$ is located well forward of where the center of gravity $G_2$ would be if there were no alternator.

Embodiment of FIGS. 6–9

FIGS. 6–9 show a further embodiment of the invention which is generally similar to the embodiment of FIGS. 2–5 and is adapted to be incorporated in an outboard motor having the same general construction as shown in FIG. 1. This embodiment differs from the previously described embodiment only in the relocation of certain components. Therefore, where the components are of the same construction as that previously described, they have been identified by the same reference numerals and will be described again only insofar as it is necessary to understand the construction and operation of this embodiment.

In this embodiment, the intake system, indicated generally by the reference numeral 151, is different in that the air inlet device and silencer 85 is positioned to the rear of the protective cowling and on the side of the cylinder head assembly 81 opposite to the intake manifold 89. Thus, its intake portion 86 and inlet opening 87 extends upwardly rather than sidewardly.

With this positioning of the intake opening 87, some of the intake air from one of the cowling inlet openings 84 can flow directly into the opening 87 as seen by the arrow C1. The remainder of the air will flow in a more circuitous path as indicated by the arrow C2 in FIG. 6.

The intake manifold thus is provided with runners 152 that extend across the rear end of the engine and above the cam cover 102 so as to enter the intake manifold section 89 from the rear.

Because the inlet silencer device 85 is removed from the forward portion of the power head 55, the alternator 119 and its pulley 108, as well as the starter motor 124 and its pinion gear 123, may be rotated in a counter-clockwise direction as seen from above so as to place these elements on opposite sides of a longitudinally extending plane that contains the axis of rotation of the crankshaft 63. Thus the center of gravity in this embodiment is moved further in a forward direction from the previous embodiment to further reduce vibrations.

This also permits the ECU 125 to be positioned in the space occupied by the starter motor 124 in the previous embodiment and thus still keep it in the path of intake air flow for cooling purposes, while removing it from other heated components of the engine.

This embodiment also shows another component of the fuel supply system for the fuel injector 96. This is comprised of a fuel filter 153 which is mounted in proximity to the vapor separator 127 and fuel pump 126. This shortens the length of the fuel lines connecting these components. This configuration of the intake manifold 152 also opens up the access to the vapor separator 127 and fuel pump 126, as well as placing the fuel filter 153 in an easily accessed position.

In all other regards, this embodiment is the same as that previously described. Therefore, further description of this embodiment is not believed to be necessary to permit those skilled in the art to practice the invention thereof.

Figure 7:
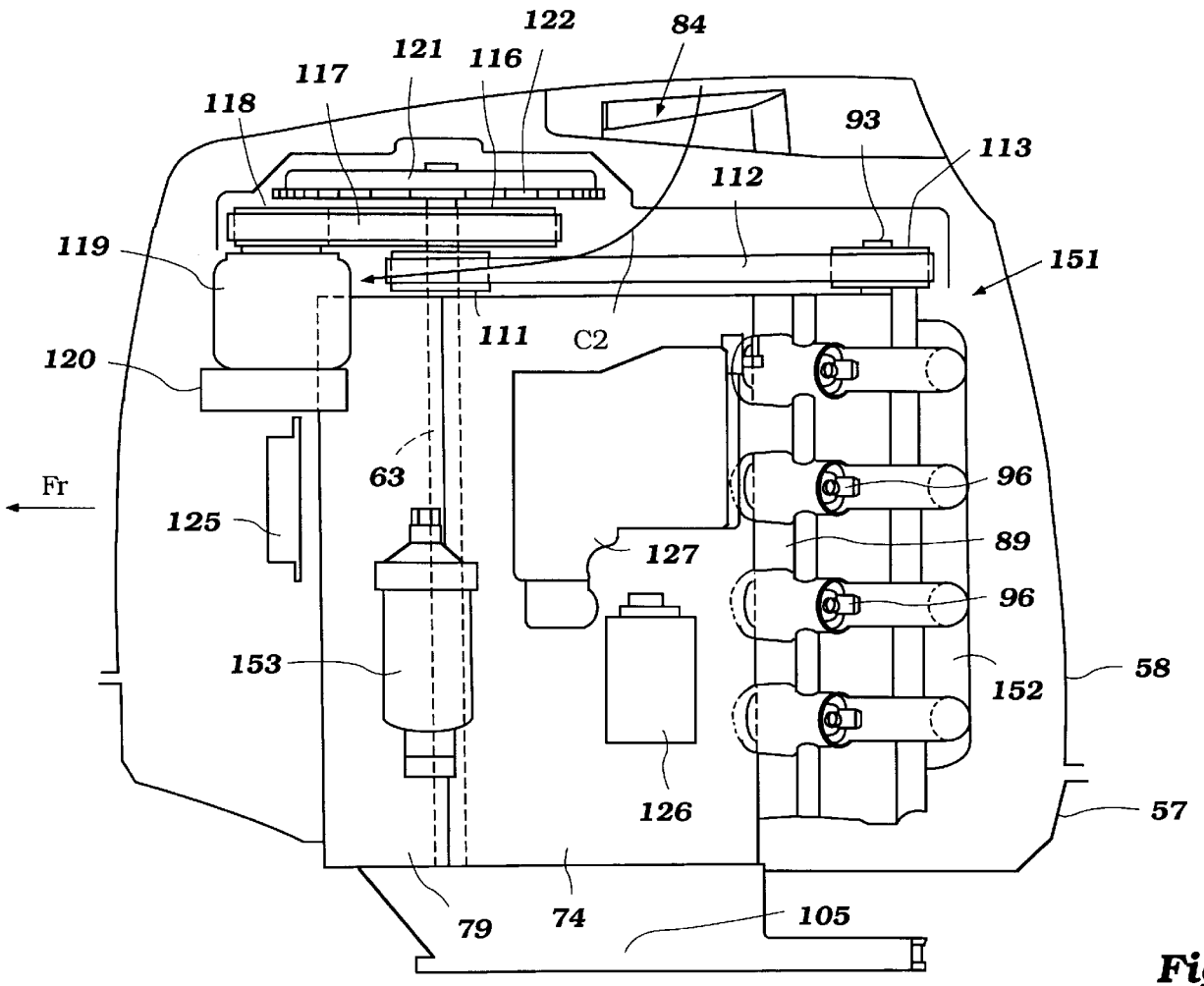
FIG. 7 is a left hand side elevational view of this embodiment and is in part similar to FIG. 3.
Figure 8:
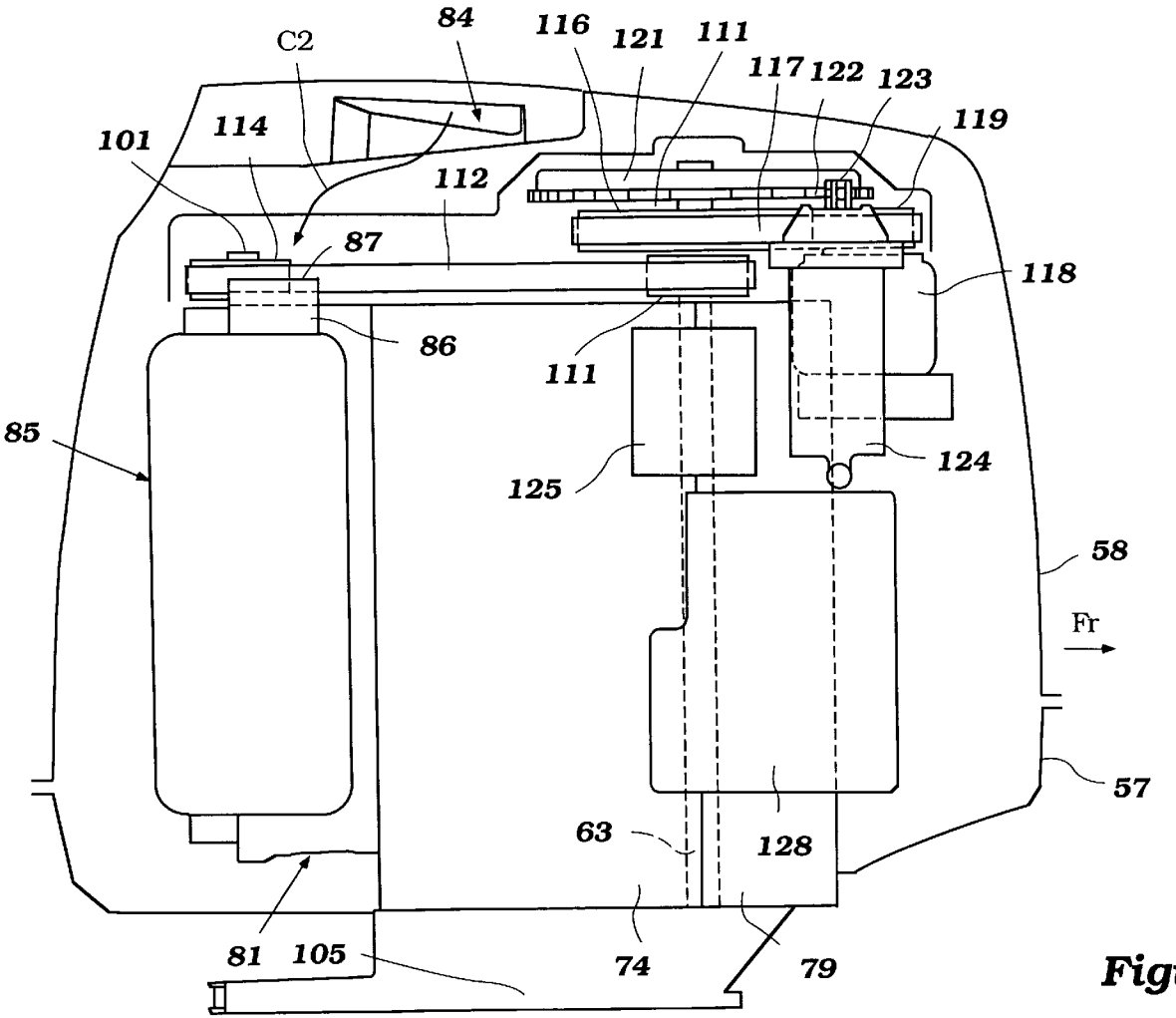
FIG. 8 is a right side elevational view of this embodiment and is in part similar to FIG. 4.
Figure 9:
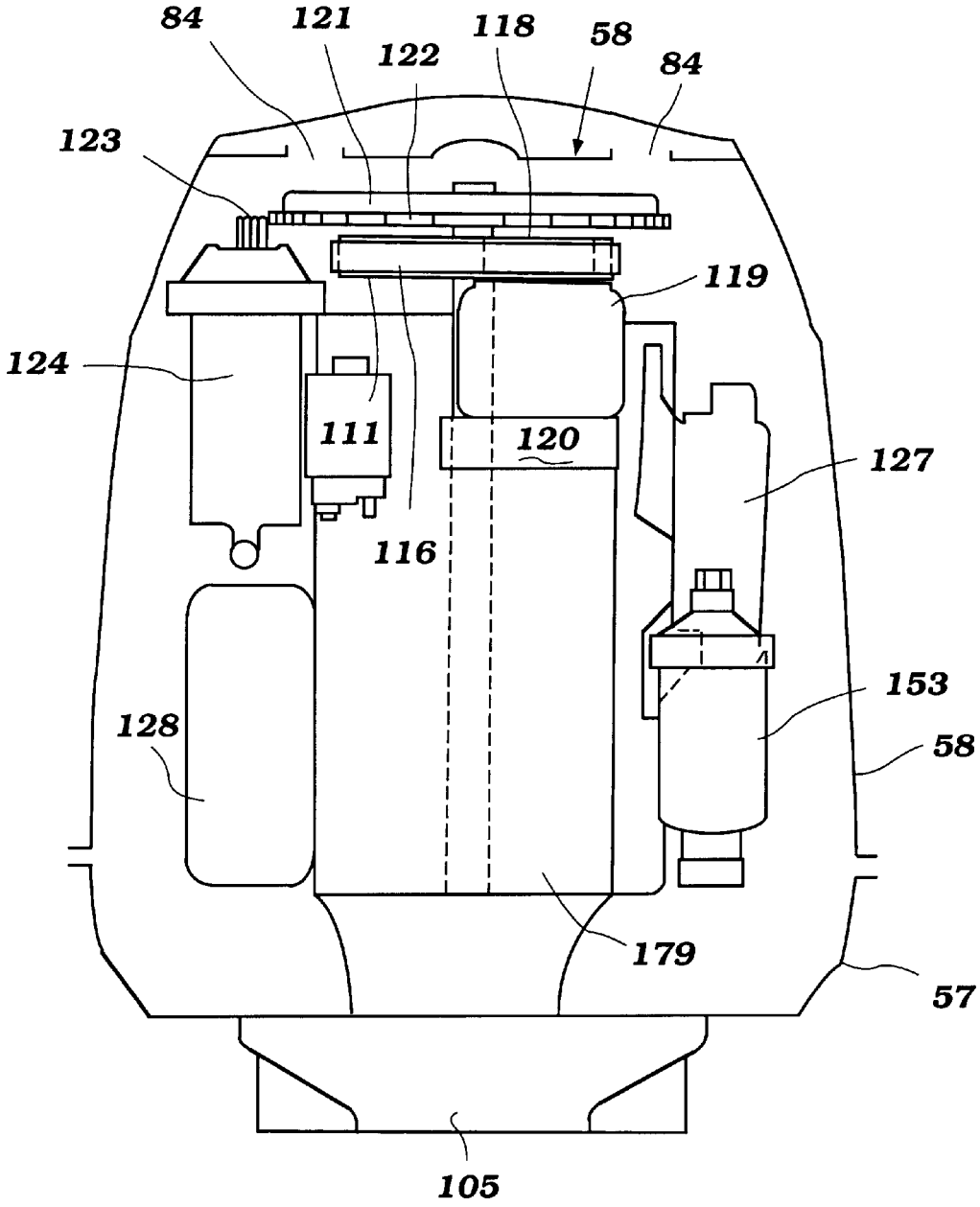
FIG. 9 is a front elevational view of this embodiment and is in part similar to FIG. 5.
Figure 10:
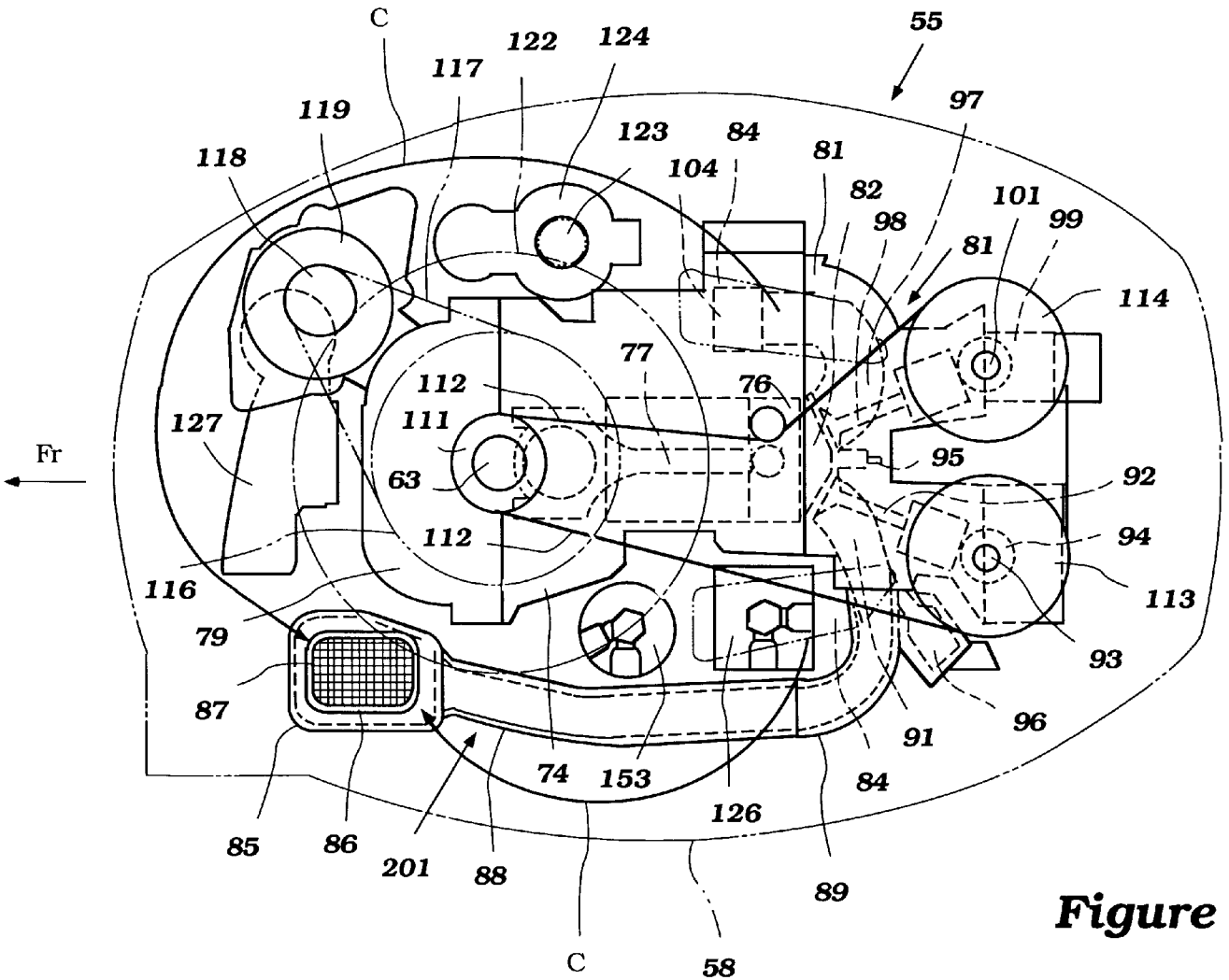
FIG. 10 is a top plan view, in part similar to FIGS. 2 and 6, and shows a third embodiment of the invention.
Figure 11:
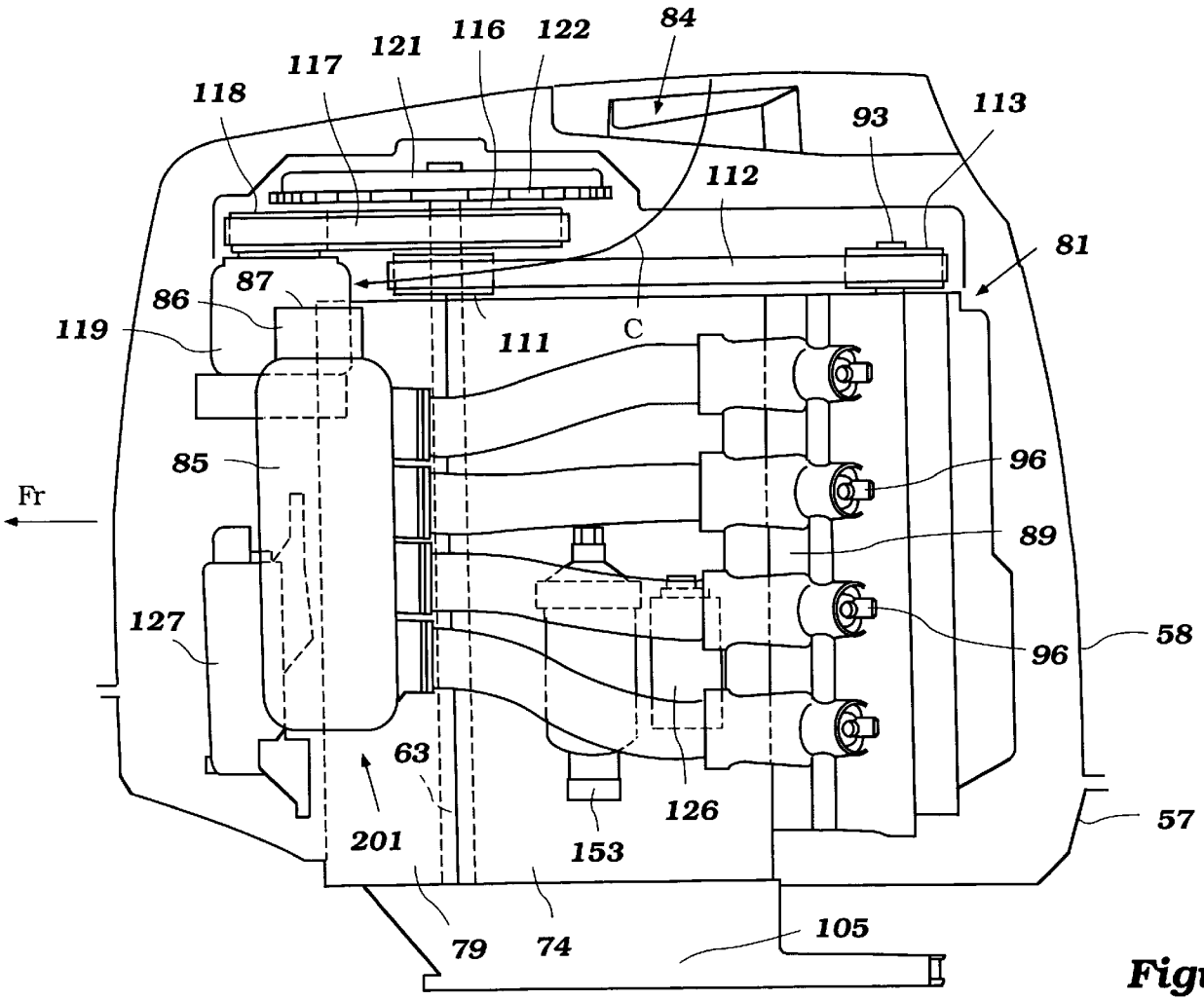
FIG. 11 is a left hand side view of this embodiment and is in part similar to FIGS. 3 and 7.
Figure 12:
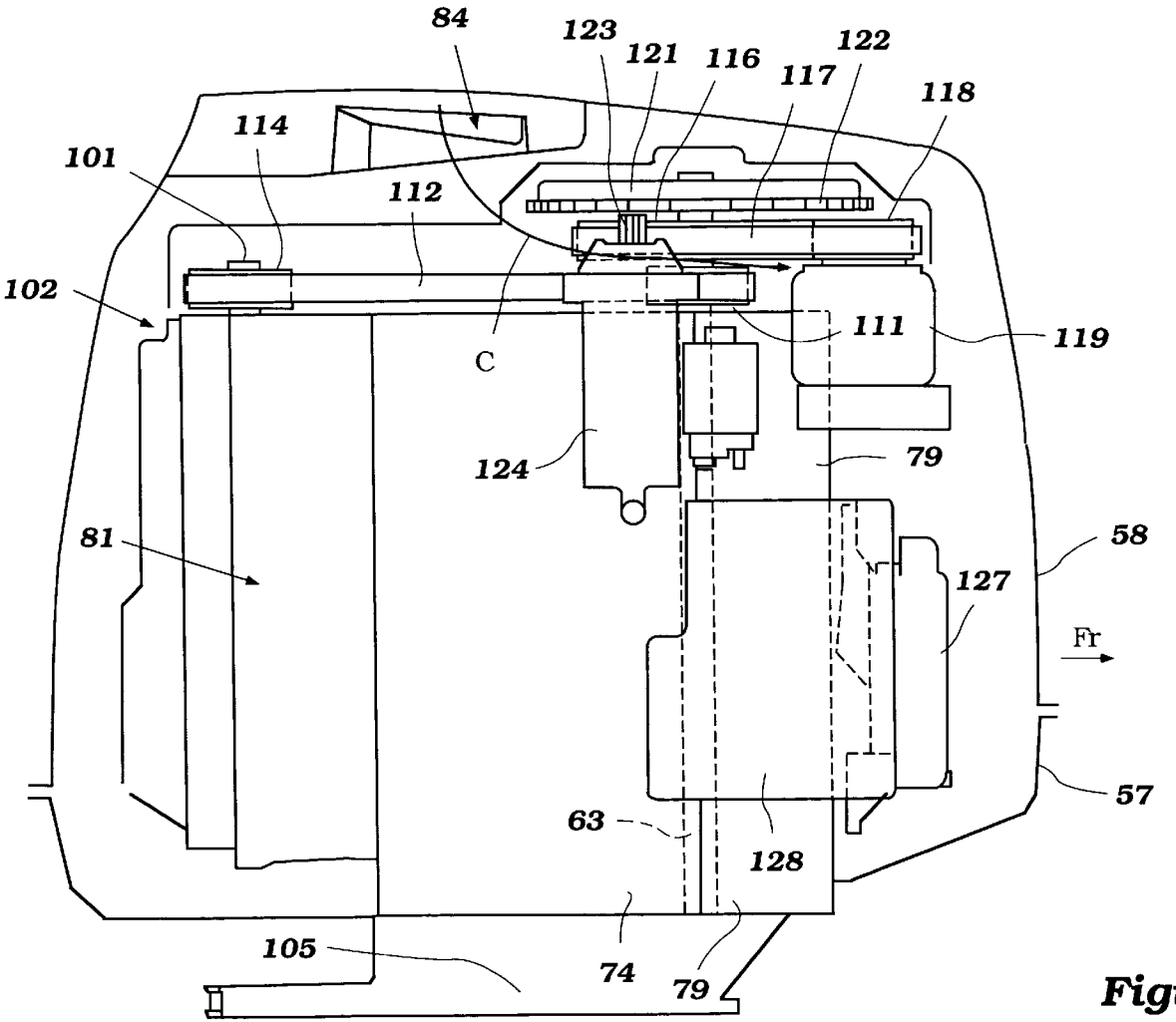
FIG. 12 is a right side elevational view of this embodiment and is in part similar to FIGS. 4 and 9.
Figure 13:
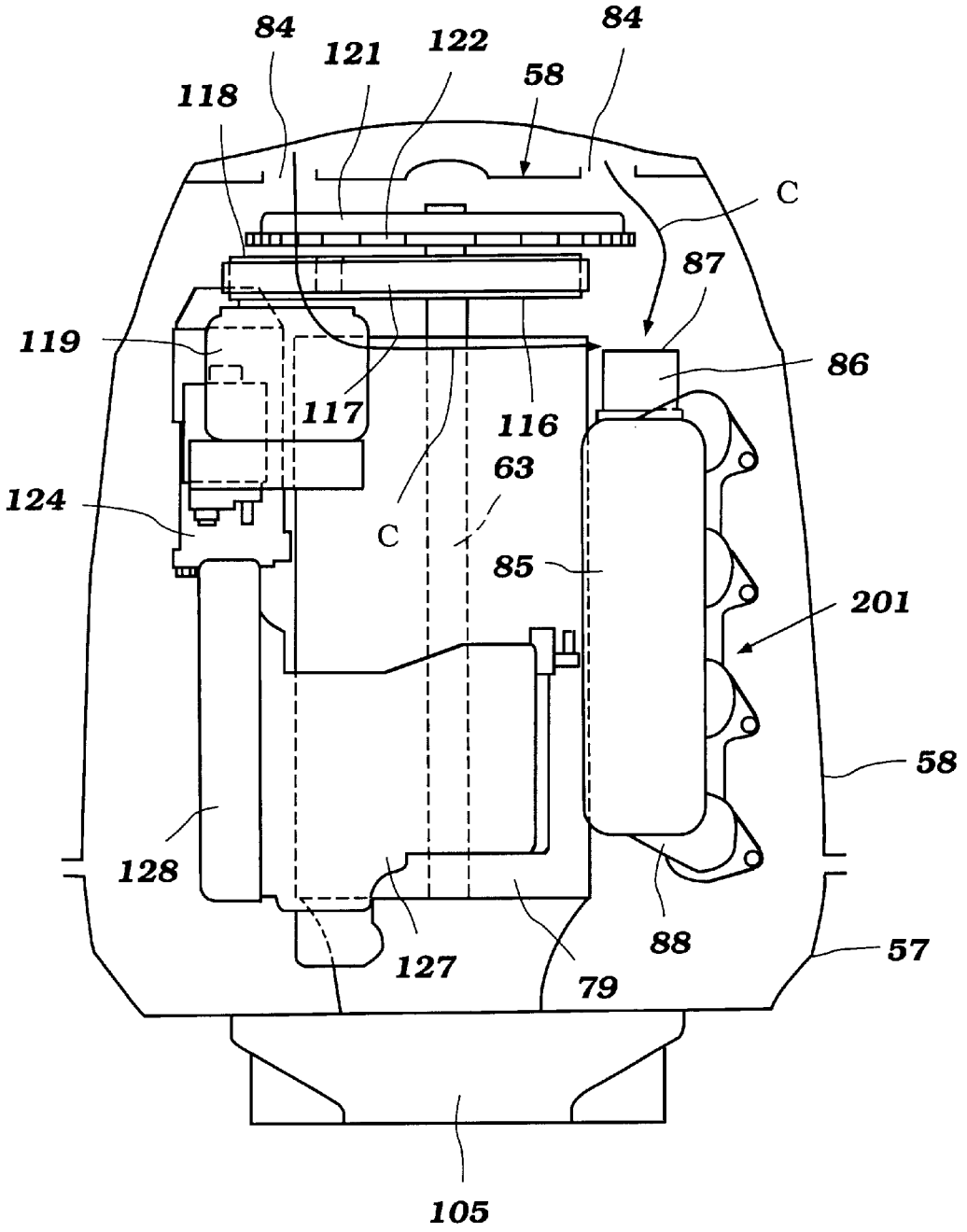
FIG. 13 is a front elevational view of this embodiment and is in part similar to FIGS. 5 and 9.
Figure 14:
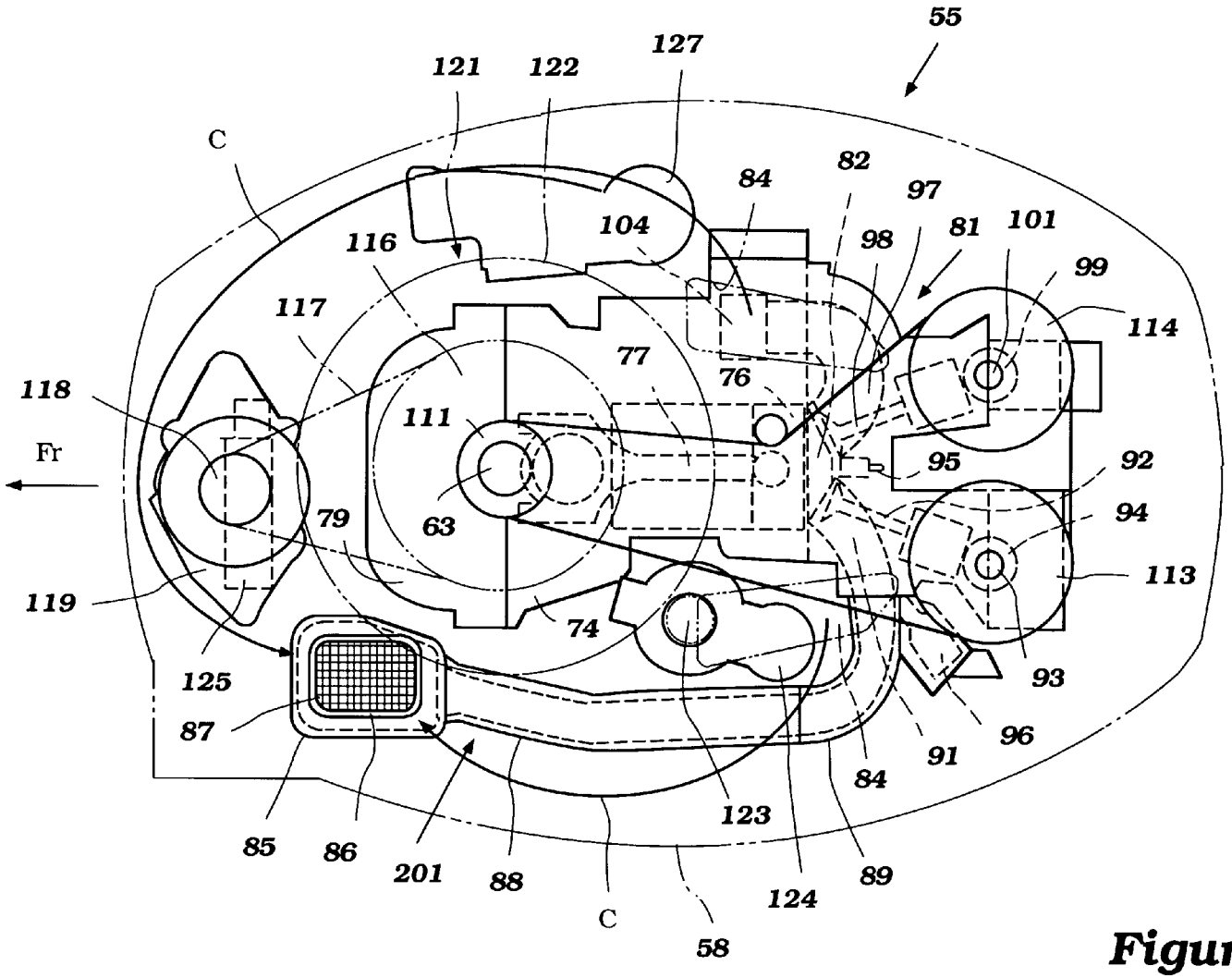
FIG. 14 is a top plan view, in part similar to FIGS. 2, 6 and 10, and shows a fourth embodiment of the invention.
Figure 15:
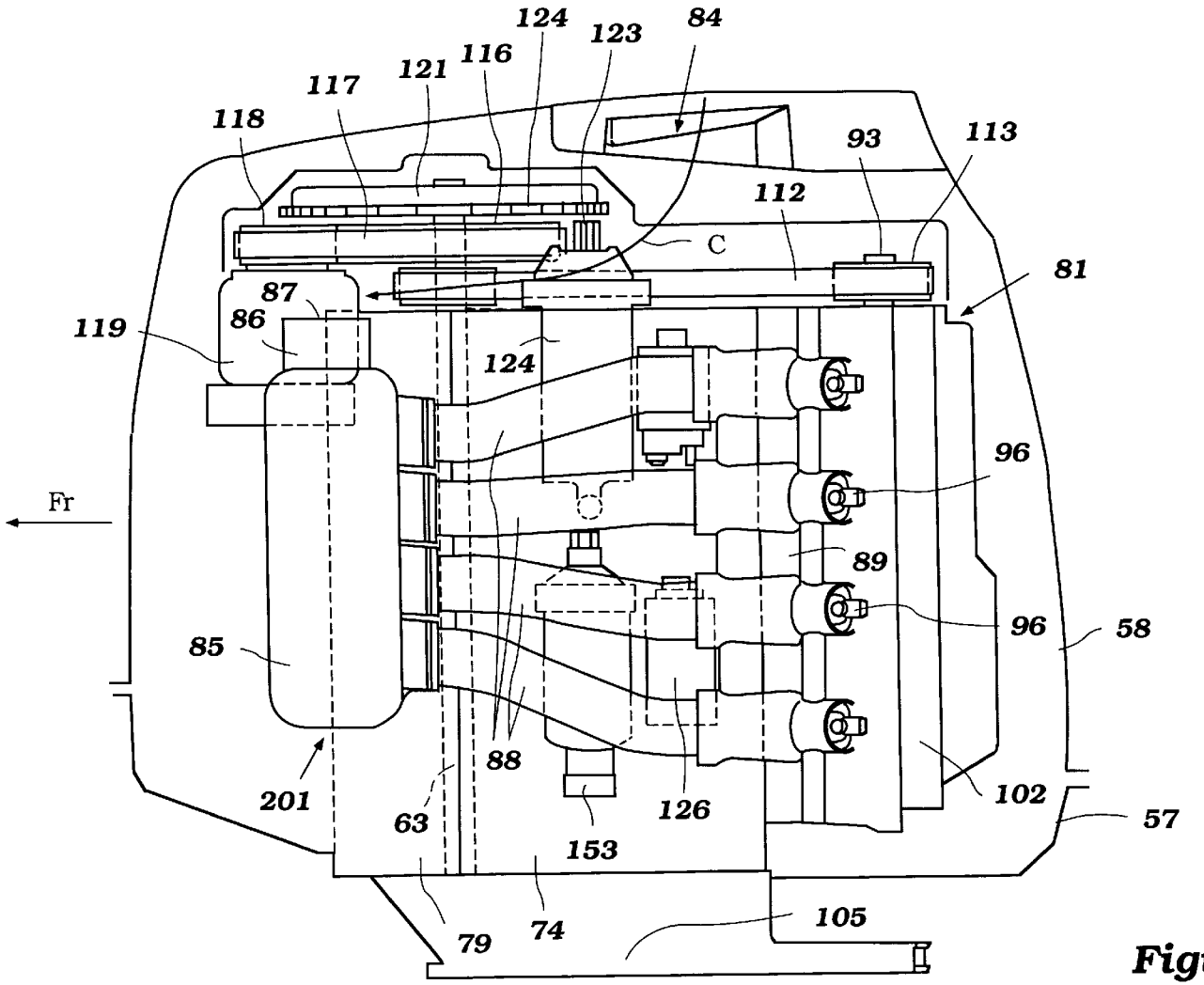
FIG. 15 is a left side elevational view of this embodiment and is in part similar to FIGS. 3,7 and 11.
Figure 16:
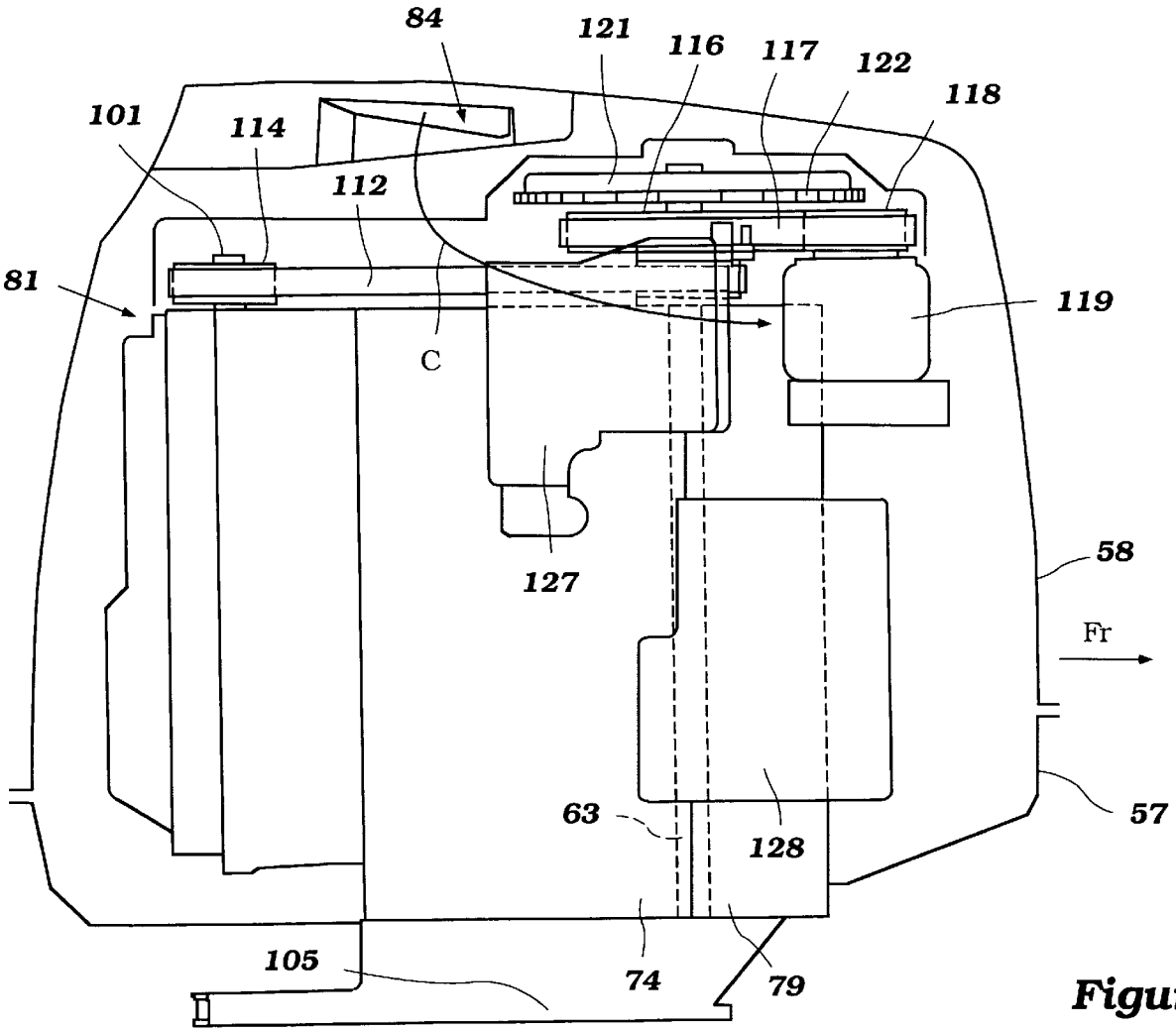
FIG. 16 is a right side elevational view of this embodiment and is in part similar to FIGS. 4, 8 and 12.
Figure 17:
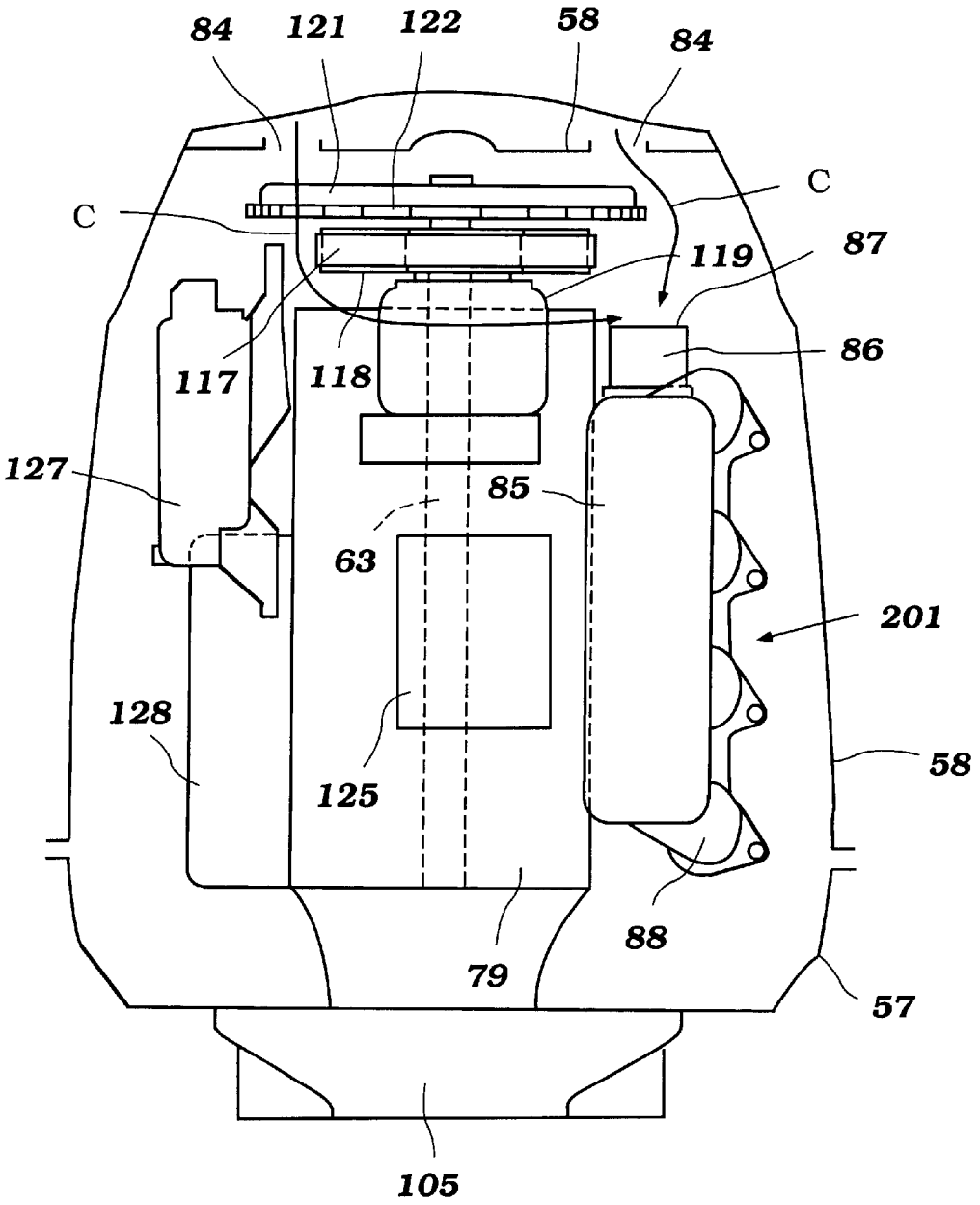
FIG. 17 is a front elevational view of this embodiment and is in part similar to FIGS. 5, 9 and 13.

FIG. 7 also shows an alternative location for the ECU 125. This being basically the same as the location of the previously described embodiment.

Embodiment of FIGS. 10–13

FIGS. 10–13 show another embodiment which is different from those embodiments previously described in the location of certain of the components and again in utilizing a slightly different shape for the induction system, which is indicated generally by the reference numeral 201 in this embodiment. In this arrangement, the air inlet and silencer device 85 is positioned adjacent the crankcase member 79 but, in this case, it is positioned to the side of the crankcase member rather than forward of it. Also, this embodiment uses the upwardly facing air inlet section 86 so that the inlet opening 87 faces upwardly.

In this embodiment, the alternator 119 and starter motor 124 are located in the same orientation as in FIGS. 2–5. Thus, a large space is opened on the forward side of the crankcase member 79. The vapor separator 127 is, therefore, located in this area.

With this orientation, the manifold runners 88 are as previously described but are shorter in length because the inlet device and silencer 85 is positioned closer to the cylinder head 81 than in the first embodiment.

In all other regards, this embodiment is the same as those previously described and thus, further description of the components of this embodiment are not believed to be necessary to permit those skilled in the art to practice this embodiment of the invention.

Embodiment of FIGS. 14–17

This embodiment utilizes an induction system of the type shown in the embodiment of FIGS. 10–13 and it has, therefore, been identified by the same reference numeral. In this embodiment, however, the alternator 119 is moved to the area immediately forwardly of the forward edge of the crankcase member 79 so as to open up the space on the side of the engine opposite the induction system 201.

With this embodiment, the starter motor 124 is positioned behind the intake manifold runners 88 which is not a particular problem because this is not a component that requires frequent servicing. Thus, the vapor separator 127 can be positioned on the opposite side of the engine so as to provide more ready access to this component.

In all other regards, this embodiment is the same as those previously described and therefore further description of it is not believed to be necessary to permit those skilled in the art to practice the invention.

Figure 18:
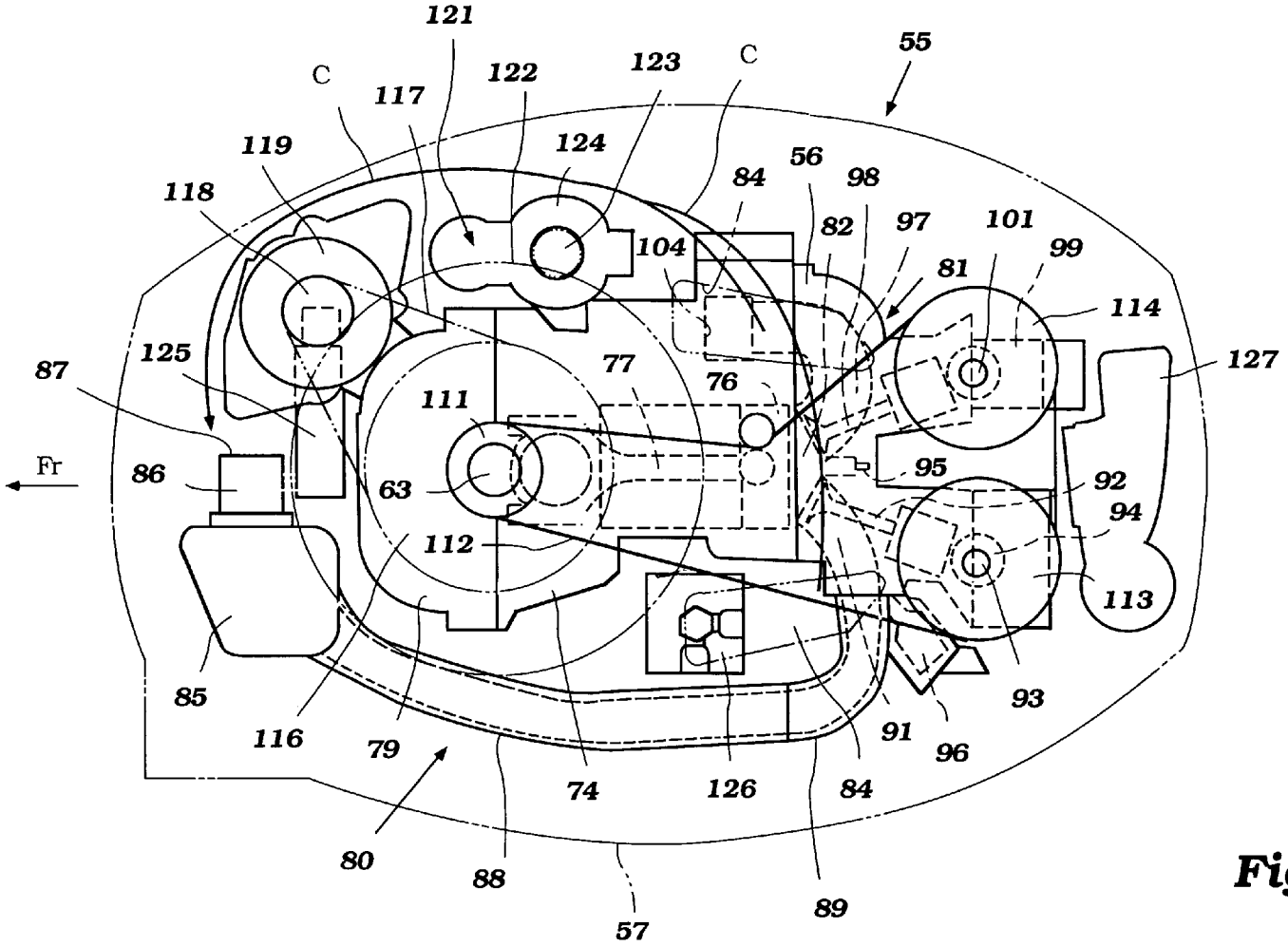
FIG. 18 is a top plan view, in part similar to FIGS. 2, 6, 10 and 14, and shows a fifth embodiment of the invention.
Figure 19:
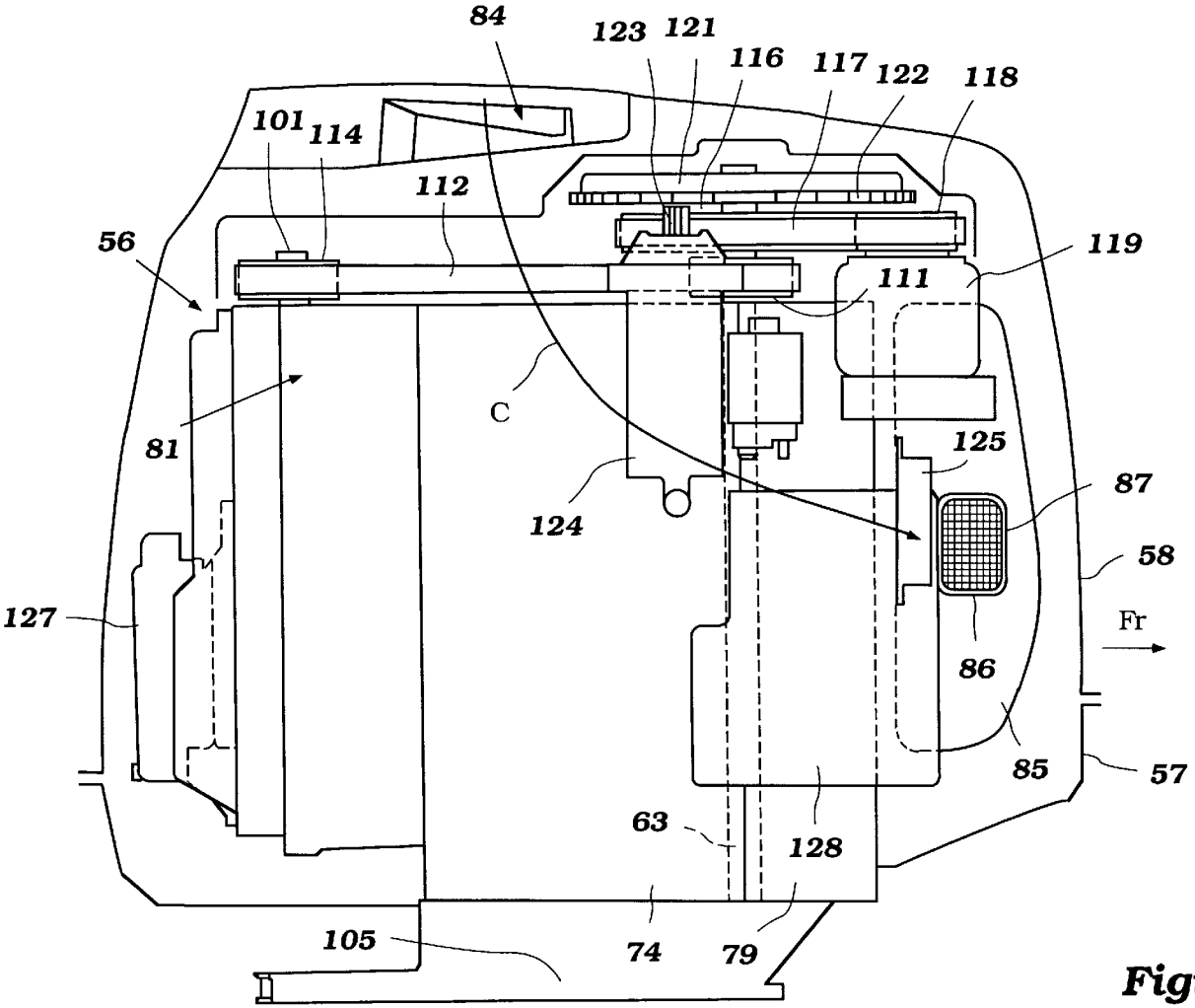
FIG. 19 is a left side elevational view of this embodiment and is in part similar to FIGS. 3,7, 11 and l5.
Figure 20:
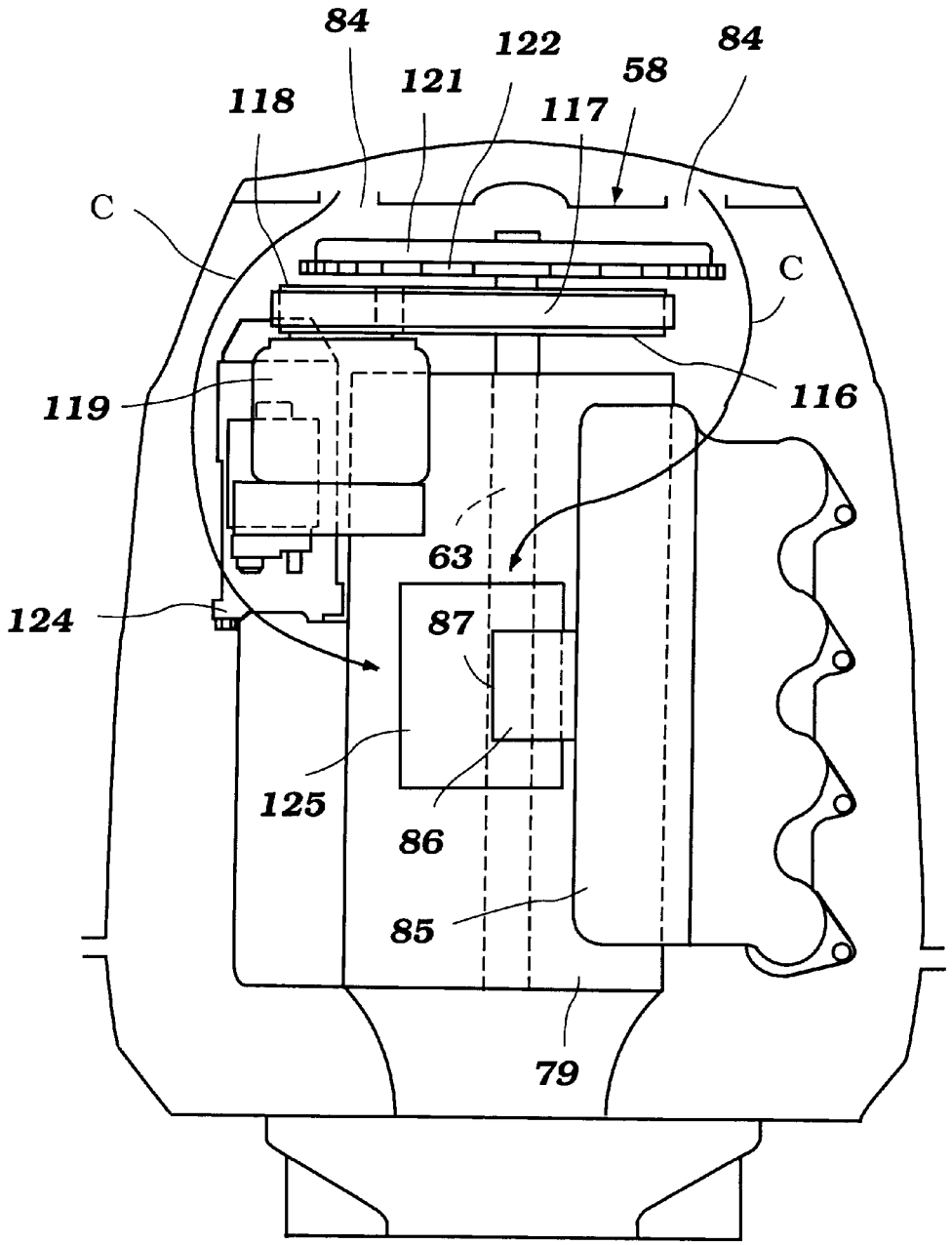
FIG. 20 is a front elevational view of this embodiment and is in part similar to FIGS. 5, 9, 13 and 17.

Embodiment of FIGS. 18–20

This embodiment is quite similar to the embodiment of FIGS. 2–5 and thus, the components of this embodiment are identified by the same reference numerals as those applied in earlier figures where the components are the same. In this embodiment, the vapor separator 127 is moved from the area behind the manifold runners 81 to the rear of the engine so that it will be positioned adjacent the cam cover 102. This places it in closer proximity to the fuel injectors 96. In all other regards, this embodiment is the same as those previously described and, therefore, a further description of this embodiment is not believed to be necessary to permit those skilled in the art to practice it.

Figure 21:
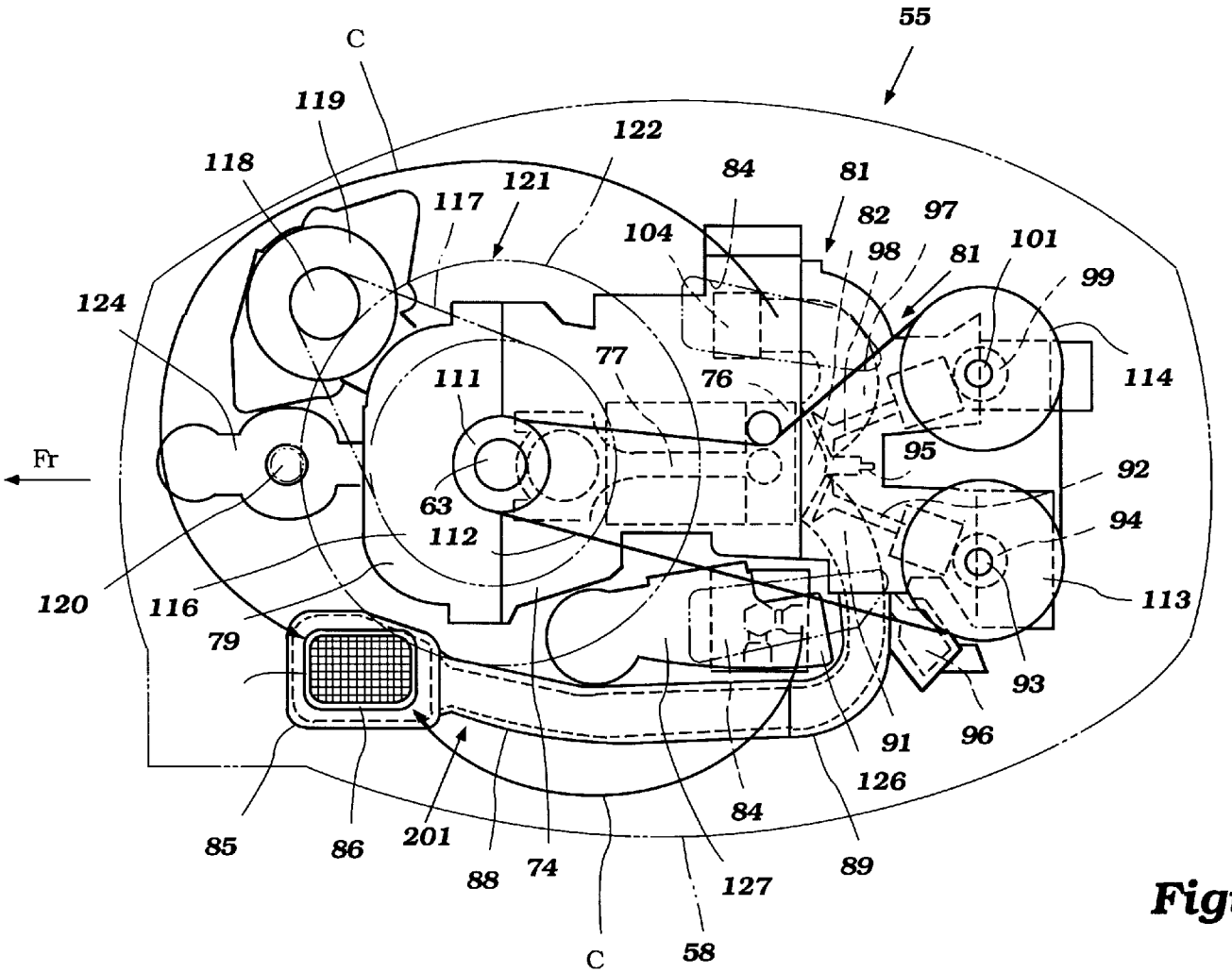
FIG. 21 is a top plan view, in part similar to FIGS. 2, 6, 10, 14 and 18, and shows a sixth embodiment of this invention.
Figure 22:
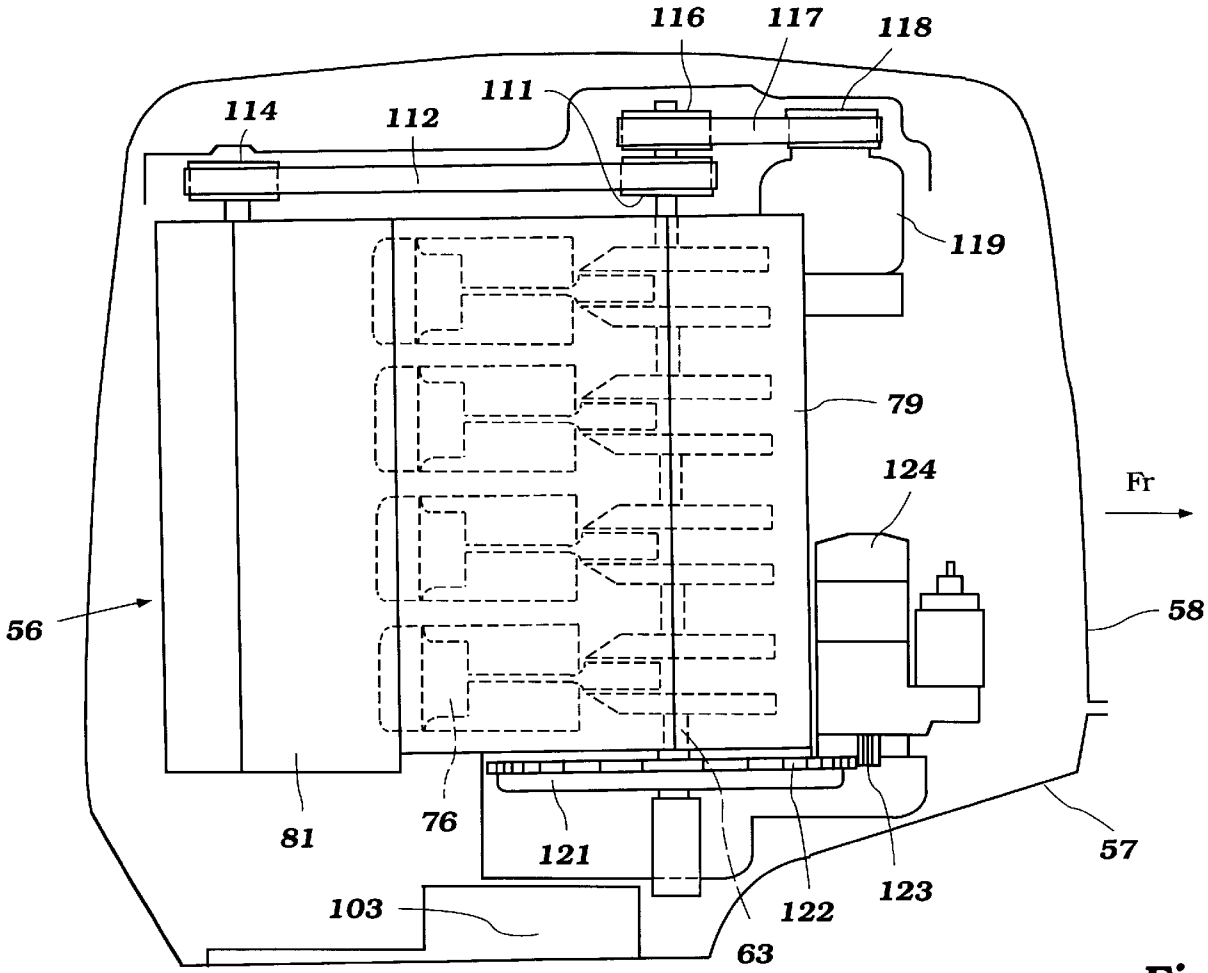
FIG. 22 right side elevational view of this embodiment and is in part similar to FIGS. 4, 8, 12 and 16.

Embodiment of FIGS. 21 and 22

In all of the embodiments as thus far described, the flywheel magneto 121 has been mounted on the upper end of the crankshaft. This embodiment is quite similar to the embodiment of FIGS. 10–13 in the configuration of the induction system and the location of some of the components. With this embodiment, however, the flywheel magneto 121 and the associated ring gear 122 are mounted on the lower portion of the engine at a point above the exhaust guide 105. Thus, the starter motor 124 is mounted at the lower end of the engine and its starter gear 123 extends downwardly rather than upwardly.

This opens up the upper area of the engine for the cam drive that includes the belt 112 and the alternator drive which includes the drive belt 117. In this embodiment, the starter motor extends to the front of the engine while the alternator lies above it rather than below it. This further assists in a forward location of the center of gravity. Again, however, the alternator and starter motor lie have major portions that lie within the outer periphery of the ring gear 122 in top plan view.

With this embodiment, the positioning of the vapor separator 127 is the same as in the embodiment of FIGS. 2–6 as are the other components of the fuel injection system.

SUMMARY

From the foregoing description, it should be readily apparent that the described embodiments of the invention provide a very compact arrangement for a four-cycle, multi-cylinder internal combustion engine. The arrangements shown provide adequate area for all of the accessories and permits the use of a cam drive and alternator drive off of the crankshaft without interference with each other and while permitting the various accessories to be located in convenient and well-accessed locations. Also the center of gravity is forwardly located to reduce vibrations.

Of course, the foregoing description is that of preferred embodiments of the invention. Various changes and modifications may be made without departing from the spirit and scope of the invention, as defined by the appended claim.

What is claimed is:

1. An outboard motor comprised of a power head consisting of a multi-cylinder, four cycle internal combustion engine having at least one overhead mounted cam shaft for operating valves thereof and a surrounding protective cowling and a driveshaft housing and lower unit containing a propulsion device within said lower unit depending from said power head, said engine being mounted within said protective cowling so that its crankshaft rotates about a vertically extending axis, said crankshaft being coupled to a drive shaft that depends into said driveshaft housing and lower unit for driving said propulsion device, a flywheel affixed to an end of said crankshaft in spaced relation to a body of said engine in which said crankshaft is journalled, a first accessory drive affixed to said crankshaft at a point between said flywheel and an adjacent portion of said engine body for driving at least one engine accessory, said at least one engine accessory being mounted at an upper end of said engine and at least in part within the outer peripheral surface of said flywheel in top plan view, and a second accessory drive driven directly from said crankshaft at a point disposed adjacent said first accessory drive and between said flywheel and said engine body for driving said camshaft.

2. An outboard motor as set forth in claim 1, wherein the at least one engine accessory is external to an outer body of said engine.

3. An outboard motor as set forth in claim 1, wherein the second accessory drive is disposed below the first accessory drive.

4. An outboard motor as set forth in claim 3, wherein the first accessory drive comprises a flexible transmitter.

5. An outboard motor as set forth in claim 3, wherein the second accessory drive comprises a flexible transmitter.

6. An outboard motor as set forth in claim 5, wherein the first accessory drive also comprises a flexible transmitter.

7. An outboard motor as set forth in claim 1, wherein the flywheel has a ring gear affixed to its outer periphery and further including an electric starter motor mounted on the engine and engaged with the flywheel ring gear for electric starting of said engine.

8. An outboard motor as set forth in claim 7, wherein the electric starter motor is disposed within the outer peripheral surface of the flywheel in top plan view.

9. An outboard motor as set forth in claim 8, wherein the flywheel is fixed to the upper end of the crankshaft.

10. An outboard motor as set forth in claim 9, wherein the alternator and electric starter motor are disposed on opposite sides of a longitudinal plane containing the rotational axis of the crankshaft.

11. An outboard motor as set forth in claim 8, wherein the accessory comprises an alternator.

12. An outboard motor as set forth in claim 1, wherein the flywheel is fixed to the upper end of the crankshaft at a point above the first accessory drive.

13. An outboard motor as set forth in claim 12, wherein the cylinders of the engine extend rearwardly from the axis of the crankshaft and the drive shaft is positioned forwardly in the driveshaft housing.

14. An outboard motor as set forth in claim 13, wherein the flywheel has a ring gear affixed to its outer periphery and further including an electric starter motor mounted on the engine and engaged with the flywheel ring gear for electric starting of said engine.

15. An outboard motor as set forth in claim 14, wherein the accessory comprises an alternator, said alternator being disposed forwardly of a plane containing the axis of rotation of the crankshaft and perpendicular to a longitudinal center line of the outboard motor.

16. An outboard motor as set forth in claim 15, wherein the electric starter motor is also disposed forwardly of the plane.

* * * * *